US011183379B2

(12) United States Patent
Patel

(10) Patent No.: US 11,183,379 B2
(45) Date of Patent: Nov. 23, 2021

(54) DEVICES AND METHODS TO IMPROVE BACKGROUND EQUIVALENT CONCENTRATIONS OF ELEMENTAL SPECIES

(71) Applicant: PERKINELMER HEALTH SCIENCES CANADA, INC., Woodbridge (CA)

(72) Inventor: Pritesh Patel, Pickering (CA)

(73) Assignee: PerkinElmer Health Sciences Canada, Inc., Woodbridge (CA)

( * ) Notice: Subject to any disclaimer, the term of this patent is extended or adjusted under 35 U.S.C. 154(b) by 0 days.

(21) Appl. No.: 16/835,966

(22) Filed: Mar. 31, 2020

(65) Prior Publication Data

US 2020/0343083 A1 Oct. 29, 2020

Related U.S. Application Data

(60) Provisional application No. 62/827,483, filed on Apr. 1, 2019.

(51) Int. Cl.

| | |
|---|---|
| ***H01J 49/10*** | (2006.01) |
| ***H05H 1/30*** | (2006.01) |
| ***H01J 49/04*** | (2006.01) |
| ***H01J 49/34*** | (2006.01) |

(52) U.S. Cl.

CPC ..... *H01J 49/105* (2013.01); *H01J 49/045* (2013.01); *H01J 49/34* (2013.01); *H05H 1/30* (2013.01)

(58) Field of Classification Search

CPC ..... H01J 49/045; H01J 49/105; H01J 49/34; H05H 1/30; H05H 1/0037; H05H 1/42

See application file for complete search history.

(56) References Cited

U.S. PATENT DOCUMENTS

| | | | | |
|---|---|---|---|---|
| 5,223,711 | A * | 6/1993 | Sanderson | H01J 49/025 250/281 |
| 5,969,352 | A * | 10/1999 | French | H01J 49/105 250/288 |
| 7,554,660 | B2 * | 6/2009 | Hammer | G01N 21/68 356/316 |
| 2007/0075051 | A1 * | 4/2007 | Morrisroe | G01J 1/42 219/121.52 |
| 2011/0298376 | A1 * | 12/2011 | Kanegae | B01J 19/088 315/111.51 |
| 2013/0062515 | A1 * | 3/2013 | Quimby | H01J 49/0422 250/282 |
| 2014/0224984 | A1 * | 8/2014 | Morrisroe | H01J 49/105 250/288 |
| 2014/0264000 | A1 * | 9/2014 | Hartwell | H01J 37/244 250/281 |
| 2016/0135277 | A1 * | 5/2016 | Duimstra | H01J 49/105 356/316 |
| 2017/0106448 | A1 * | 4/2017 | Boulos | B01J 2/02 |

(Continued)

*Primary Examiner* — Wyatt A Stoffa

(74) *Attorney, Agent, or Firm* — Rhodes IP PLC; Christopher Rhodes

(57) ABSTRACT

Methods and systems that can use a gas comprising a nitrogen center that is introduced upstream of a plasma sustained in a torch are described. In some configurations, the gas comprising the nitrogen center can be introduced as a gas upstream of the plasma and through a sample introduction device. Mass spectrometers and optical emission systems that can use the gas comprising the nitrogen center are also described.

19 Claims, 11 Drawing Sheets

(56) References Cited

U.S. PATENT DOCUMENTS

| | | | | |
|---|---|---|---|---|
| 2017/0326649 | A1* | 11/2017 | Boulos | H05H 1/42 |
| 2018/0220520 | A1* | 8/2018 | Alavi | H05H 1/30 |
| 2019/0062891 | A1* | 2/2019 | Belashchenko | H05H 1/28 |

* cited by examiner

Table 3

| Element | No Nitrogen Gas | Nitrogen Gas Added |
|---|---|---|
| Li7 | 0.03 | 0.04 |
| Be9 | 0.08 | 0.07 |
| Na23 | 0.86 | 0.36 |
| Mg24 | 0.82 | 0.93 |
| K39 | 0.62 | 0.26 |
| Ca40 | 4.72 | 6.24 |
| Ti48 | 0.53 | 1.62 |
| V51 | 1.27 | 0.87 |
| Cr52 | 0.69 | 0.26 |
| Mn55 | 0.20 | 0.16 |
| Fe56 | 2.24 | 1.59 |
| Ni58 | 0.58 | 0.15 |
| Co59 | 0.46 | 0.15 |
| Ni60 | 0.50 | 0.14 |
| Cu63 | 0.26 | 0.08 |
| Zn64 | 0.15 | 0.45 |
| Cu65 | 0.25 | 0.10 |
| Zn66 | 0.09 | 0.28 |
| As75 | 0.95 | 0.38 |
| Se82 | 0.00 | 0.00 |
| Rb85 | 0.30 | 0.07 |
| Sr88 | 0.01 | 0.01 |
| Ag107 | 0.20 | 0.66 |
| Cd111 | 0.00 | 0.01 |
| In115 | 0.01 | 0.00 |
| Cs133 | 0.02 | 0.01 |
| Ba138 | 0.01 | 0.02 |
| Ce140 | 0.00 | 0.00 |
| Tl205 | 2.02 | 0.99 |
| Pb208 | 0.02 | 0.01 |
| Bi209 | 0.03 | 0.04 |
| U238 | 0.06 | 0.04 |

FIG. 13

DEVICES AND METHODS TO IMPROVE BACKGROUND EQUIVALENT CONCENTRATIONS OF ELEMENTAL SPECIES

PRIORITY APPLICATION

This application is related to, and claims priority to and the benefit of, U.S. Provisional Application No. 62/827,483 filed on Apr. 1, 2019, the entire disclosure of which is hereby incorporated herein by reference for all purposes.

TECHNOLOGICAL FIELD

Certain configurations are described of devices and methods that can reduce plasma interferences and/or background signals when detecting one or more elements. In some examples, signals from interfering species and/or background signals can be reduced to improve background equivalent concentrations.

BACKGROUND

Elemental species in samples can be analyzed in many different manners. Background signals and interferences often reduce the ability to detect certain elemental species at low levels.

SUMMARY

Various aspects, embodiments, configurations and examples are described that can use a gas comprising a nitrogen center, e.g., a gas that comprises a molecule or compound comprising at least one nitrogen atom bonded to another atom, in chemical analyses. The presence of the gas comprising the nitrogen center can, for example, reduce background signals and/or the presence of interfering species during analysis of at least certain elemental species. This reduction can improve background equivalent concentration for at least certain elemental species.

In an aspect, a method comprises introducing a gas comprising a nitrogen center, e.g., a gas comprising a nitrogen center, upstream of a torch configured to sustain an inductively coupled plasma using a plasma gas, wherein the gas comprising the nitrogen center is introduced upstream of the sustained inductively coupled plasma. In some embodiments, the gas comprising the nitrogen center is introduced into a sample introduction device, at a point between a sample introduction device and a plasma, into the torch upstream of the plasma, etc. In some configurations, a gas comprising the nitrogen center is introduced in a separate gas flow from a plasma gas flow and a separate gas flow from any cooling gases provided to the torch to cool glassware of the torch.

In some examples, the gas comprising the nitrogen center is introduced into the torch in a gas flow that is separate from the plasma gas provided to the torch and is separate from any cooling gases provided to the torch to cool glassware of the torch.

In other examples, the method comprises introducing the gas comprising the nitrogen center into a spray chamber positioned upstream of the torch and fluidically coupled to a sample inlet of the torch. In some embodiments, the gas comprising the nitrogen center is introduced through a secondary port of the spray chamber or a primary port of the spray chamber or some other port of the spray chamber. In certain instances, the secondary port of the spray chamber is positioned perpendicular to a longitudinal axis of the spray chamber. In other embodiments, the method comprises switching off the introduction of the gas comprising the nitrogen center into the spray chamber when a hard-to-ionize element is being analyzed using the inductively coupled plasma. In some examples, the method comprises switching on the introduction of the gas comprising the nitrogen center into the spray chamber when an element other than a hard-to-ionize element is being analyzed using the inductively coupled plasma. In additional examples, the spray chamber is fluidically coupled to a nebulizer, and wherein a flow rate of sample through the nebulizer is substantially constant as the switching on and switching off of the gas comprising the nitrogen center into the spray chamber is performed.

In some examples, the method comprises configuring the introduced gas comprising the nitrogen center to comprise up to about 50% by volume of a total gas flow introduced into the torch.

In certain embodiments, the method comprises introducing the gas comprising the nitrogen center in a flow that is a parallel flow, a perpendicular flow or a counter flow to a flow direction of bulk gas flow through the spray chamber.

In some instances, the gas comprising the nitrogen center is nitrogen gas, ammonia gas, nitrous oxide, nitrogen dioxide or a gas comprising ammonium ions.

In certain embodiments, the torch is positioned in an aperture of an induction device configured to provide radio frequency energy into the torch to sustain the inductively coupled plasma in the torch using argon as the plasma gas, and wherein the spray chamber is configured to provide a laminar flow of sample into the torch, wherein the laminar flow of the sample also comprises the introduced gas comprising the nitrogen center.

In some examples, a power of about 500 Watts to about 1800 Watts is provided to the induction device to sustain the inductively coupled plasma in the torch. In some embodiments, the argon gas introduced into the torch to sustain the plasma in the torch comprises a purity between 99.99% argon and 99.9999% argon.

In some examples, a mass analyzer fluidically coupled to an outlet of the torch. In other examples, an optical detector is present and is configured to receive an optical emission from excited ions in the torch.

In other embodiments, the method comprises introducing the gas comprising the nitrogen center into a port of the torch that provides a gas to the central channel of the plasma. In some examples, the gas comprising the nitrogen center is nitrogen gas, ammonia gas, nitrous oxide, nitrogen dioxide or a gas comprising ammonium ions. In other embodiments, the torch is positioned in an aperture of an induction device configured to provide radio frequency energy into the torch to sustain the inductively coupled plasma in the torch using argon as the plasma gas. In some examples, the method comprises switching off the introduction of the gas comprising the nitrogen center into the torch when a hard-to-ionize element is being analyzed using the inductively coupled plasma. In other embodiments, the method comprises switching on the introduction of the gas comprising the nitrogen center into the torch when an element other than a hard-to-ionize element is being analyzed using the inductively coupled plasma.

In another aspect, a mass spectrometer system comprises a sample introduction device comprising a first port and a second port, wherein the first port receives a first gas, and the second port receives a second gas different from the first gas, and wherein the second gas comprises a nitrogen center, a torch fluidically coupled to the sample introduction device and configured to receive sample from the sample introduction device at a sample inlet of the torch, an induction device configured to provide radio frequency energy into the torch to sustain an inductively coupled plasma in the torch to ionize the sample, a mass analyzer fluidically coupled to a sample outlet of the torch and configured to receive ions from the torch, a detector fluidically coupled to the mass analyzer, and a processor configured to prevent introduction of the second gas into the sample introduction device when a sample comprising a hard-to-ionize element is being analyzed using the mass spectrometer system and permit entry of the second gas into the sample introduction device when an element other than a hard-to-ionize element is being analyzed using the mass spectrometer system.

In certain embodiments, the sample introduction device comprises a spray chamber positioned upstream of the torch and fluidically coupled to a sample inlet of the torch. In other embodiments, the spray chamber comprises the second port through which the second gas is introduced and comprises the first port through which the first gas is introduced. In some examples, the second port of the spray chamber is positioned perpendicular to a longitudinal axis of the spray chamber. In other examples, the second port is orthogonal to the first port. In some embodiments, the processor is further configured to control an amount of the second gas comprising the nitrogen center introduced into the sample introduction device. In some embodiments, the processor is further configured to select a specific gas comprising a nitrogen center from a plurality of gases comprising a nitrogen center based on an analyte to be analyzed using the mass spectrometer.

In some examples, the mass spectrometer system further comprises a nebulizer fluidically coupled to the spray chamber. In other embodiments, the spray chamber is configured to provide a laminar flow of sample into the sample inlet of the torch, wherein the laminar flow of the sample also comprises the second gas comprising the nitrogen center. In some embodiments, a third port is present on the spray chamber, wherein the third port receives a gas different than the first gas and the second gas.

In another aspect, an optical emission spectrometer system comprises a sample introduction device comprising a first port and a second port, wherein the first port receives a first gas, and the second port receives a second gas, different from the first gas, and wherein the second gas comprises a nitrogen center, a torch fluidically coupled to the sample introduction device and configured to receive sample from the sample introduction device at a sample inlet of the torch, an induction device configured to provide radio frequency energy into the torch to sustain an inductively coupled plasma in the torch to ionize the sample, an optical detector configured to detect optical emissions of excited analyte in the torch, and a processor configured to prevent introduction of the second gas into the sample introduction device when a sample comprising a hard-to-ionize element is being analyzed using the optical emission spectrometer system and permit entry of the second gas into the sample introduction device when an element other than a hard-to-ionize element is being analyzed using the optical emission spectrometer system.

In certain embodiments, the sample introduction device comprises a spray chamber positioned upstream of the torch and fluidically coupled to a sample inlet of the torch. In some examples, the spray chamber comprises the second port through which the second gas is introduced and comprises the first port through which the first gas is introduced. In other examples, the second port of the spray chamber is positioned perpendicular to a longitudinal axis of the spray chamber. In other examples, the second port is orthogonal to the first port. In some examples, the processor is further configured to control an amount of the second gas comprising the nitrogen center introduced into the sample introduction device. In some examples, the processor is further configured to select a specific gas comprising a nitrogen center from a plurality of gases comprising a nitrogen center based on an analyte to be analyzed using the optical emission spectrometer. In other examples, the system further comprises a nebulizer fluidically coupled to the spray chamber. In some embodiments, the spray chamber is configured to provide a laminar flow of sample into the inlet of the torch, wherein the laminar flow of the sample also comprises the second gas comprising the nitrogen center. In other embodiments, a third port is present on the spray chamber, wherein the third port receives a gas different than the first gas and the second gas.

In another aspect, a spray chamber configured to fluidically couple to a nebulizer at an inlet end of the spray chamber to receive a liquid sample from the nebulizer and provide an aerosolized sample spray at an outlet end of the spray chamber to an ionization device fluidically coupled to the outlet end of the spray chamber is described. In some examples, the spray chamber comprises an outer chamber comprising the inlet end, the outlet end and dual makeup gas inlet ports each configured to receive a gas to provide a tangential gas flow within the outer chamber, an inner chamber within the outer chamber, the inner chamber comprising a plurality of internal microchannels configured to receive makeup gas introduced into the outer chamber from the dual makeup gas inlet ports, in which the inner chamber is sized and arranged to provide a laminar flow between an outer surface of the inner chamber and an inner surface of the outer chamber to reduce droplet deposition on the inner chamber, and a gas port separate from the dual makeup gas inlet ports and configured to receive a gas comprising a nitrogen center, wherein the spray chamber is configured to permit mixing of the received gas comprising the nitrogen center with makeup gas introduced into the dual makeup gas inlet ports so the gas comprising the nitrogen center is present in the aerosolized sample spray exiting the spray chamber at the outlet end of the spray chamber.

Additional aspects, embodiments, examples and configurations are described in more detail below.

BRIEF DESCRIPTION OF THE SEVERAL VIEWS OF THE DRAWINGS

Certain specific configurations are described below with reference to the figures in which:

FIG. 13 shows Table 3 which lists background equivalent concentration measurements for numerous elements.

Figure 1A:
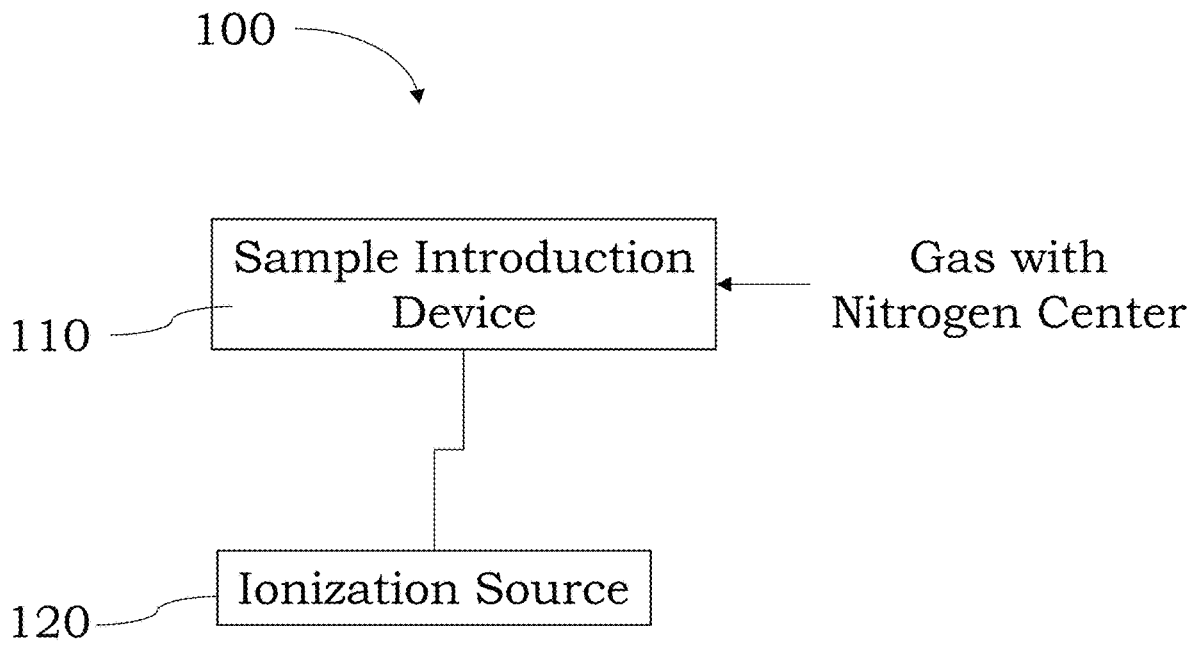
FIGS. 1A, 1B, and 1C are illustrations of systems that can receive a gas comprising a nitrogen center at different sites, in accordance with some embodiments.

It will be recognized by the person of ordinary skill in the art, given the benefit of this disclosure, that the components shown in the figure are merely illustrative of only certain components and configurations that may be used.

DETAILED DESCRIPTION

Certain configurations are described that can use a gas comprising a nitrogen center such as, for example, a gas comprising a nitrogen atom covalently bonded to another atom, to provide improved detection limits at least for certain elemental species. In some instances, the gas comprising the nitrogen center can be introduced upstream of an ionization source, directly into the ionization source or in other manners where the gas comprising the nitrogen center can be provided to the ionization source. Many different gases and gas combinations can be used as desired. The exact amount of the gas comprising the nitrogen center that is used may vary and is typically much lower than a minor amount, e.g., much less than 50%, by volume of the total gas flow, e.g., total gas flow, through the system. As noted in more detail below, when detecting certain elements in a sample it may be desirable to remove or prevent introduction of the gas comprising the nitrogen center. In some instances, the gas is or comprises a gas comprising a nitrogen center, whereas in other examples, the gas is or comprises a molecule or compound comprising a nitrogen center. As discussed below, detection can be accomplished using numerous devices and systems including a mass spectrometer, an optical emission device, an atomic absorption device, a time of flight device or other devices and systems. While not wishing to be bound by any particular theory or configuration, use of a gas comprising a nitrogen center can improve a background equivalent concentration (BEC), which is generally defined as the concentration of a given element that exhibits the same intensity as the background, measured at a given wavelength or mass. BEC's are typically calculated according to Equation [1]

$$BEC = \frac{I_{blank}}{I_{standard} - I_{blank}} + C_{standard} \quad [1]$$

where $C_{standard}$ is the concentration of the standard, $I_{blank}$ is the signal intensity of the blank and $I_{standard}$ is the signal intensity of the standard. The units of BEC are the same as that of the standard. BEC's are not detection limits but are instead the relative size of the signal from the element and the background. In general, the lower the BEC the lower the detection limit. If background signals from interfering species can be reduced, e.g., by removing or preventing the interfering species from forming, then BEC's can be improved.

In certain instances below, the phrase "hard-to-ionize element" refers to certain elemental species where ionization is difficult using an inductively coupled plasma as an ionization source. Examples of hard to ionize elements include, but are not limited to, beryllium, zinc, selenium and arsenic. The methods and systems described herein can enhance analysis of hard-to-ionize elements by selectively using or not using the gas comprising the nitrogen center. For example, the gas comprising the nitrogen center can be selectively introduced to reduce interferences and/or background signals that may exist during analysis of certain elemental species. Without wishing to be bound by any particular scientific theory, by introducing nitrogen atoms into the ionization source certain interfering ions and/or interfering ion products can be reduced to provide improved detection limits for certain elements. For example, when ions are detected based on mass-to-charge (m/z) ratios, certain interferences may be produced that have the same or similar m/z ratio as a particular analyte of interest. By introducing the gas comprising the nitrogen center, an amount of this interfering species may be reduced or otherwise not formed at all to any substantial degree. In other instances, introduction of a gas comprising a nitrogen center can increase interferences or production of interfering species at certain m/z ratios which may make detection of certain elements more difficult. As such, selective introduction of the gas comprising the nitrogen center during detection of certain elements and removal (or non-introduction) of the gas comprising the nitrogen center during detection of other elements can generally improve detection limits for most, if not all, elements in an analytical sample.

In certain embodiments, the gas comprising the nitrogen center can be introduced upstream of an ionization source, e.g., into a sample introduction device fluidically coupled to the ionization source and positioned upstream of the ionization source. Referring to FIG. 1A, a system 100 is shown comprising a sample introduction device 110 fluidically coupled to a chamber or torch that can be used to sustain a plasma or other ionization source 120. A gas comprising a nitrogen center can be introduced into the sample introduction device 110, which is positioned upstream of the ionization source 120. Where the ionization source 120 is an inductively coupled plasma, nitrogen atoms in the gas may reduce certain interfering species that form from argon gas used to sustain the plasma. In some instances, the argon has introduced into the torch to sustain the plasma in the torch comprises a purity between 99.99% argon and 99.9999% argon. As discussed further below, a processor or controller can be present in the system 100 and programmed to introduce or not introduce the gas comprising the nitrogen center depending on the particular element to be detected. The gas comprising the nitrogen center is typically introduced into the sample introduction device 110 in a minor amount, e.g., less than 50% by volume, so the sample is not diluted to a substantial degree. The gas comprising the nitrogen center can be intermittently introduced, continuously introduced, introduced in pulses or in other manners into the sample introduction device 110. The sample introduction device 110 may take many forms including a nebulizer, spray chamber, spray tip, spray nozzle or other forms which can introduce an aerosolized sample into the ionization source 120. Various illustrations and types of ionization sources that can be used in the ionization source 120 are discussed in more detail below.

Figure 1B:
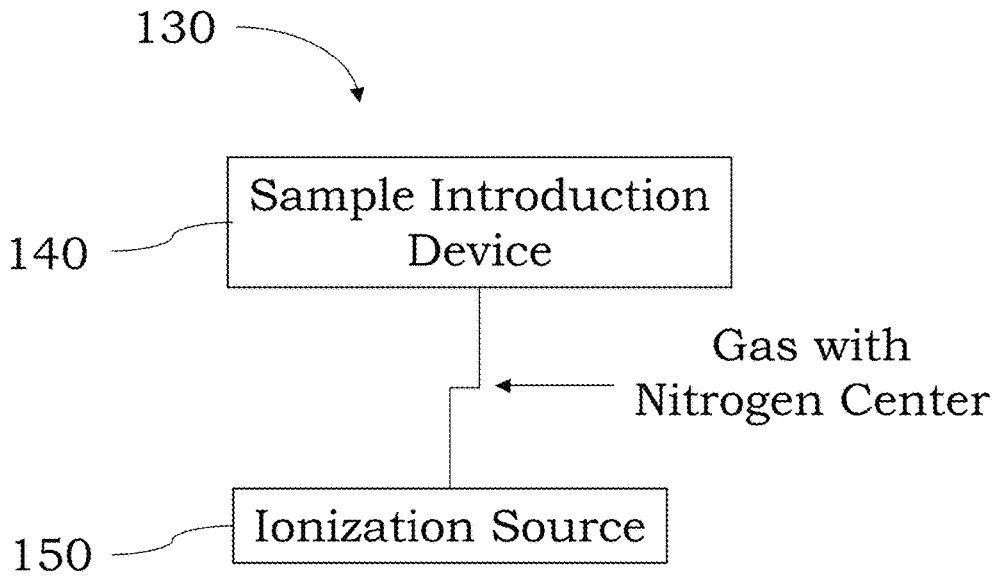

In certain configurations, the gas comprising the nitrogen center can be introduced at some point between a sample introduction device and an ionization source, e.g., through a port, gas line or a device positioned between a sample introduction device and an ionization source. Referring to FIG. 1B, a system 130 is shown that comprises a sample introduction device 140 fluidically coupled to an ionization source 150. A gas comprising a nitrogen center can be introduced into the system 130 between the ionization source 150 and the sample introduction device 140, e.g., through a port, spray chamber, flow controller, valve, manifold, etc., positioned between the sample introduction device 140 and the ionization source 150. The gas can be introduced, for example, by addition of a molecule or compound with a nitrogen center into the gas stream that exits from the sample introduction device 140. In other examples, a gas comprising a nitrogen center can be introduced into a gas stream that exits the sample introduction device 140. If desired, a mixing chamber or other device may be present between the sample introduction device 140 and the ionization source 150 to permit mixing of the gas comprising the nitrogen center with the sample exiting the sample introduction device 140 so a substantially homogeneous gas is introduced into the ionization source 150. As discussed further below, a processor or controller can be present in the system 130 and programmed to introduce or not introduce the gas comprising the nitrogen center depending on the particular element to be detected. The gas comprising the nitrogen center is typically introduced into the gas stream that exits the sample introduction device 140 in a minor amount, e.g., less than 50% by volume, so the sample is not diluted to a substantial degree. The sample introduction device 140 may take many forms including a nebulizer, spray chamber, spray tip, spray nozzle or other forms which can introduce an aerosolized sample into the ionization source 150. Various illustrations and types of ionization sources that can be used in the ionization source 150 are discussed in more detail below.

Figure 1C:
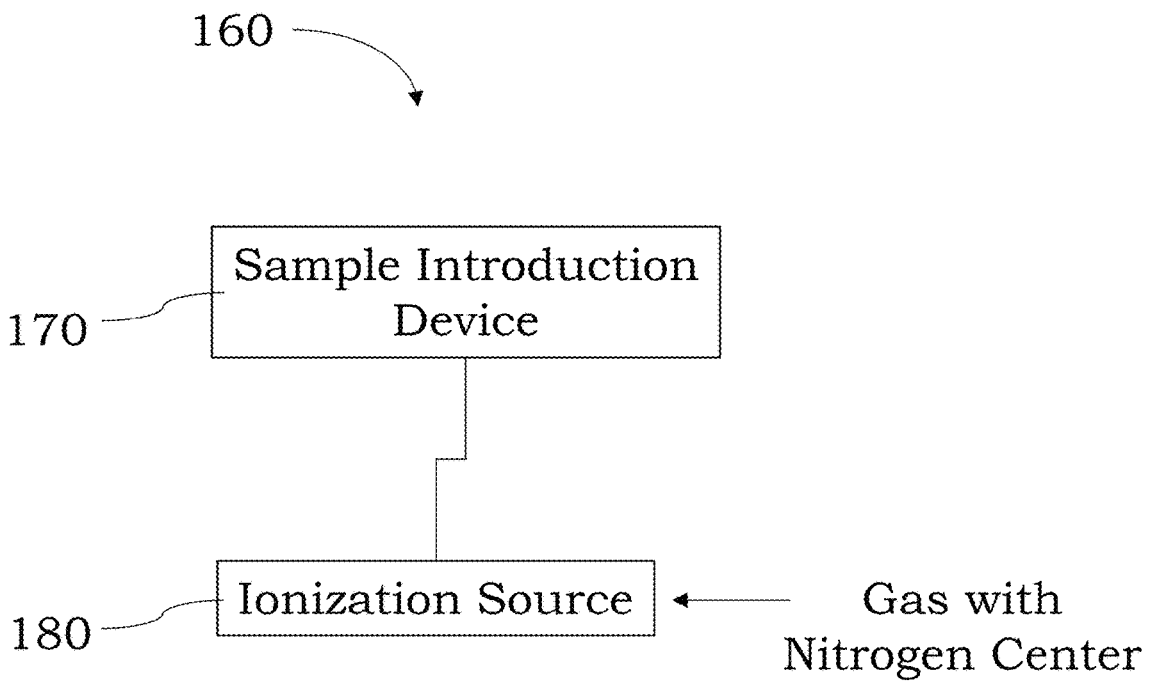

In some configurations, it may be desirable to introduce the gas comprising the nitrogen center directly into the ionization source. Referring to FIG. 1C, a system 160 is shown that comprises a sample introduction device 170 fluidically coupled to an ionization source 180. A gas comprising a nitrogen center, can be introduced directly into the ionization source 180 to reduce the formation of interferences (or prevent formation of interferences) during analysis of certain elements. The gas can be introduced directly into the ionization source 180 through a port, separate spray chamber, flow controller, valve, manifold, etc., that is fluidically coupled to the ionization source 180. For example, where the ionization source 180 comprises an inductively coupled plasma (ICP), the gas comprising the nitrogen center can be introduced or mixed directly with the plasma gas, e.g., into an inner tube of a torch configured to sustain the ICP so the gas is mixed with the plasma gas. For example, the gas comprising the nitrogen center can be mixed with an argon plasma gas flow that is used in combination with one or more induction devices to sustain a plasma within a torch. If desired, a mixing chamber or other device may be present so the gas comprising the nitrogen center and the plasma gas can be mixed so a substantially homogeneous plasma gas mixture is introduced into the ionization source 180 to sustain the plasma. The gas comprising the nitrogen center is typically not provided to any cooling gases, barrier gases or other auxiliary gases that might be used in connection with a plasma torch that sustains an inductively coupled plasma. As discussed further below, a processor or controller can be present in the system 160 and programmed to introduce or not introduce the gas comprising the nitrogen center depending on the particular element to be detected. The gas comprising the nitrogen center is typically introduced into the ionization source 180 in a minor amount, e.g., less than 50% by volume, so the plasma gas is not diluted to a substantial degree. The sample introduction device 170 may take many forms including a nebulizer, spray chamber, spray tip, spray nozzle or other forms which can introduce an aerosolized sample into the ionization source 180. Various illustrations and types of ionization sources that can be used in the ionization source 180 are discussed in more detail below.

While certain configurations are shown in FIGS. 1A-1C of different sites or points where the gas comprising the nitrogen center can be introduced, if desired, the gas comprising the nitrogen center could be introduced at two or more different sites or different fluids comprising different nitrogen centers can be introduced at two or more different sites. In addition and as noted in more detail below, the gas comprising the nitrogen center may also be used by other components of the system, e.g., by a collision cell, a reaction cell or a collision-reaction cell positioned downstream of the ionization source.

In other examples, the gas comprising the nitrogen center may be a gas that comprises one or more molecules, compounds or species that comprise a nitrogen atom. For example, the gas may be nitrogen gas, ammonia gas, nitrous oxide, nitrogen dioxide, gaseous acetonitrile or a gas comprising ammonium ions. Combinations of gases comprising a nitrogen atom can also be used. If desired, two or more different gases comprising a nitrogen center can also be introduced into the system together or two or more different gases comprising a nitrogen center can be introduced at different sites or points in a system.

Figure 2A:
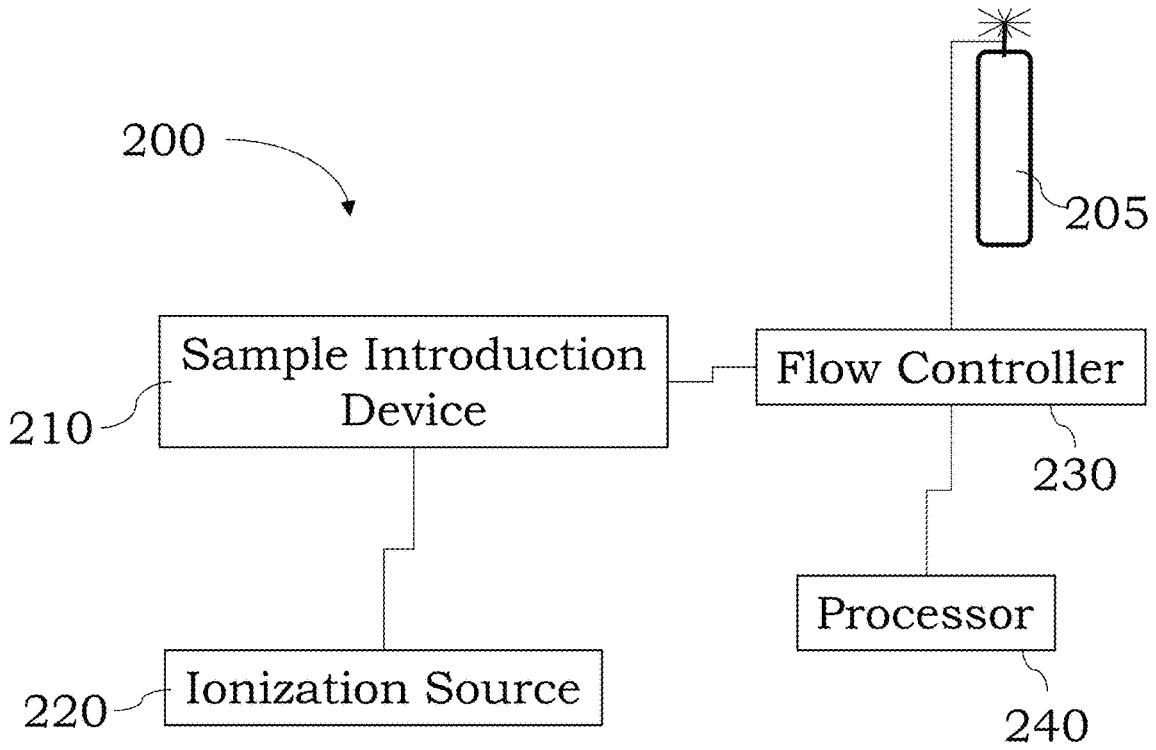
FIGS. 2A, 2B, and 2C are illustrations of systems that can receive a gas comprising a nitrogen center at different sites, in accordance with some embodiments.
Figure 2B:
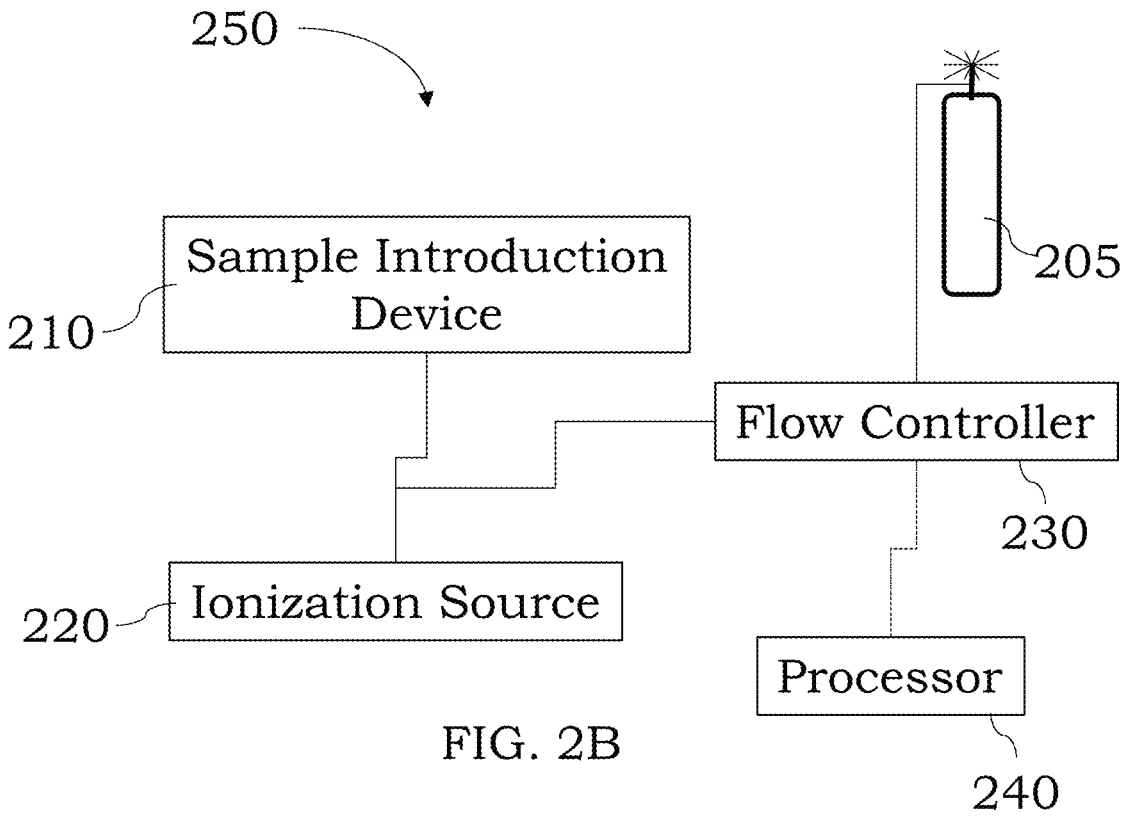
Figure 2C:
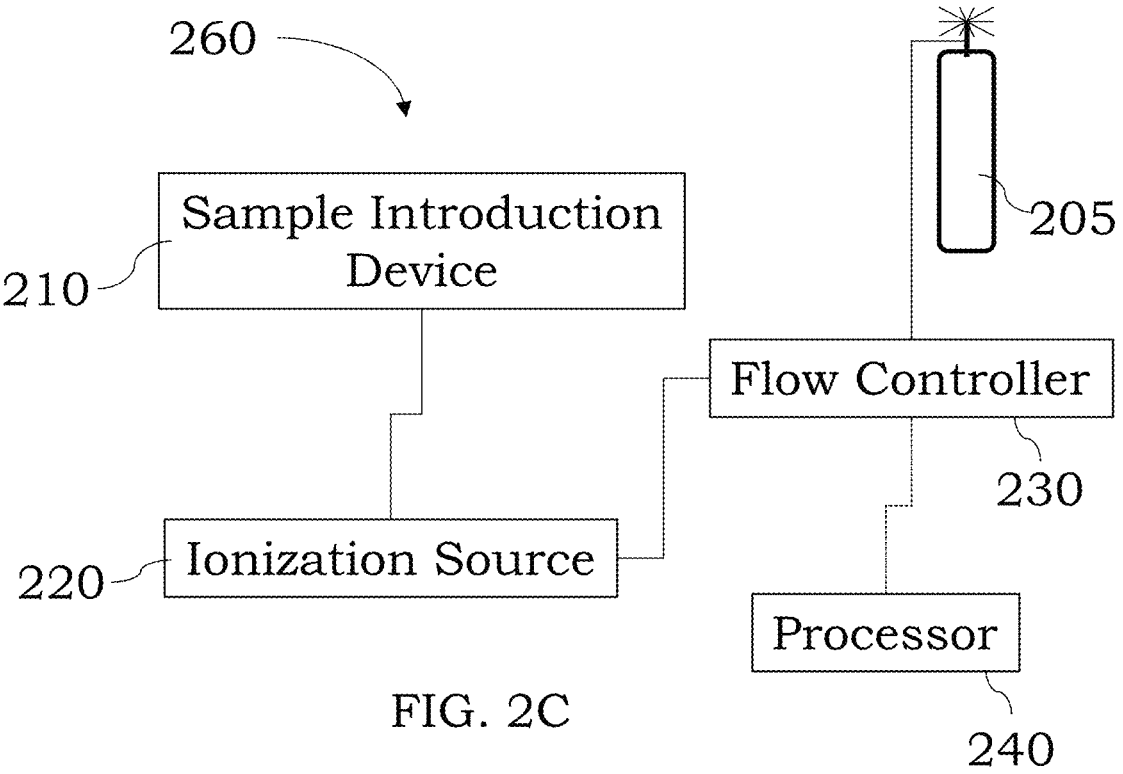

In certain configurations, the gases comprising the nitrogen center can be introduced into the system using one or more flow controllers. Referring to FIG. 2, a system 200 is shown where a flow controller 230, e.g., a mass flow controller, is fluidically coupled to a sample introduction device 210 and a gas source 205 configured to provide a gas comprising a nitrogen center. The flow controller 230 is electrically coupled to a processor 240 (or may comprise its own processor) to control the amount or volume of gas comprising the nitrogen center that is introduced into the sample introduction device 210. The gas source 205 may introduce the gas comprising the nitrogen center can be introduced into the sample introduction device 210 and mixed with sample that is provided to a downstream ionization source 220. The processor 240 can permit or prevent the gas from the gas source 205 from being introduced into the sample introduction device 210 depending on which particular element is being analyzed. As shown in FIGS. 2B and 2C, the flow controller 230 could instead be fluidically coupled between the sample introduction device 210 and the ionization source 220 (see system 250 in FIG. 2B) or directly to the ionization source 220 (see system 260 in FIG. 2C). Alternatively, the gas comprising the nitrogen center could be introduced at two or more different sites or different gases comprising different nitrogen centers can be introduced at two or more different sites. In addition and as noted in more detail below, the gas source 205 that provides the gas comprising the nitrogen center may also be used by other components of the system, e.g., by a collision cell, a reaction cell or a collision-reaction cell positioned downstream of the ionization source 220.

Figure 3A:
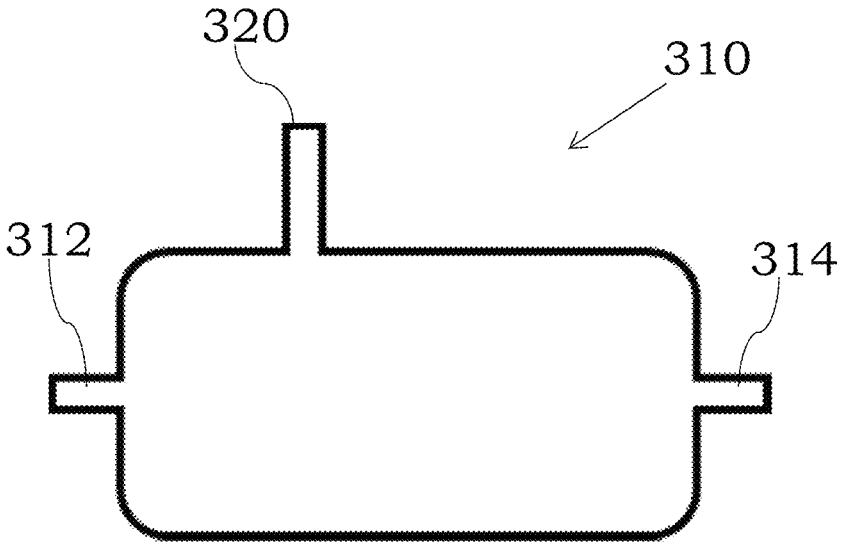
FIG. 3A is an illustration of a sample introduction device comprising two inlet ports one of which can receive a gas comprising a nitrogen center, in accordance with some examples.

In certain configurations, a gas comprising a nitrogen center can be introduced into a port of a sample introduction device. An illustration is shown in FIG. 3A, where a sample introduction device 310 comprises an inlet 312 configured to receive a sample, and an outlet 314 configured permit exit of the sample from the sample introduction device 310. Sample generally flows from the inlet 312 to the outlet 314 within the body of the device 310. A port 320 can be present on the sample introduction device 310 and fluidically coupled to a gas comprising a nitrogen center. While the port 320 is shown in a position that introduces the gas comprising the nitrogen center in a manner which is perpendicular to the flow of sample through the device 310, this positioning is not required. The gas comprising the nitrogen center can be introduced in a parallel flow, a counter flow, perpendicular to sample flow or at other angles. While not shown, a valve or other actuating device can be fluidically coupled to the port 320 to permit or prevent flow of the gas comprising the nitrogen center through the port 320. The valve may be, for example, a solenoid valve or may be present in a flow controller.

Figure 3B:
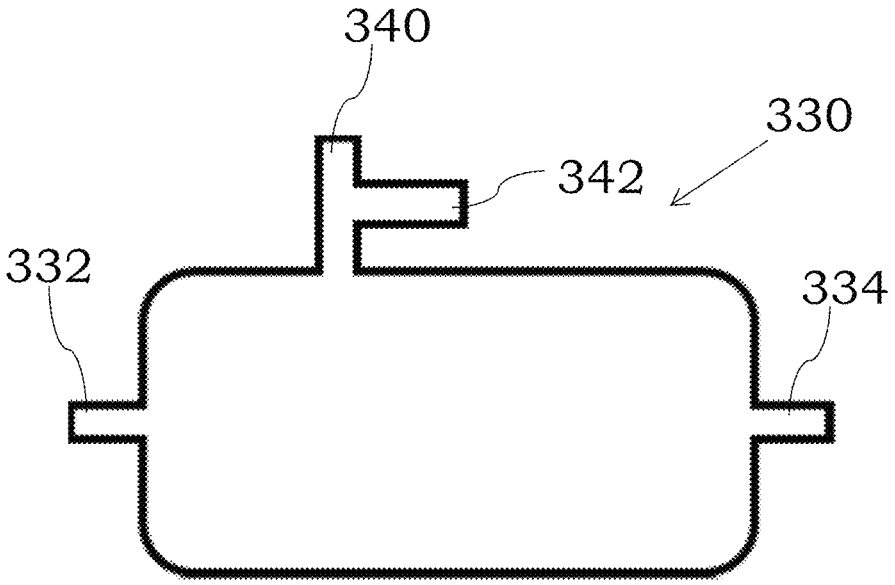
FIG. 3B is an illustration of a sample introduction device comprising three inlet ports one of which can receive a gas comprising a nitrogen center, in accordance with some examples.

In some instances, a separate port can be present on a sample introduction device. For example, in the case of a spray chamber, a separate port can be fluidically coupled to a makeup gas inlet or port to permit. One generalized illustration is shown in FIG. 3B, where a sample introduction device 330 comprises an inlet 332, an outlet 334, a first port 340, and a second port 342. A gas comprising the nitrogen center can be introduced through the port 342 and into the port 340 for mixing prior to introduction of the bulk gas from the port 340 into the body of the device 330. For example, the first port 340 may receive a gas used to carry sample analyte through the device 330 and/or to assist in isolation of individual particles, cells, etc. The gas comprising the nitrogen center can be co-introduced into the body of the device 330 with the gas introduced through the first port 340. While not shown, a valve or other actuating device can be fluidically coupled to the second port 342 to permit or prevent flow of the gas comprising the nitrogen center through the second port 342. The valve may be, for example, a solenoid valve or may be present in a flow controller.

Figure 3C:
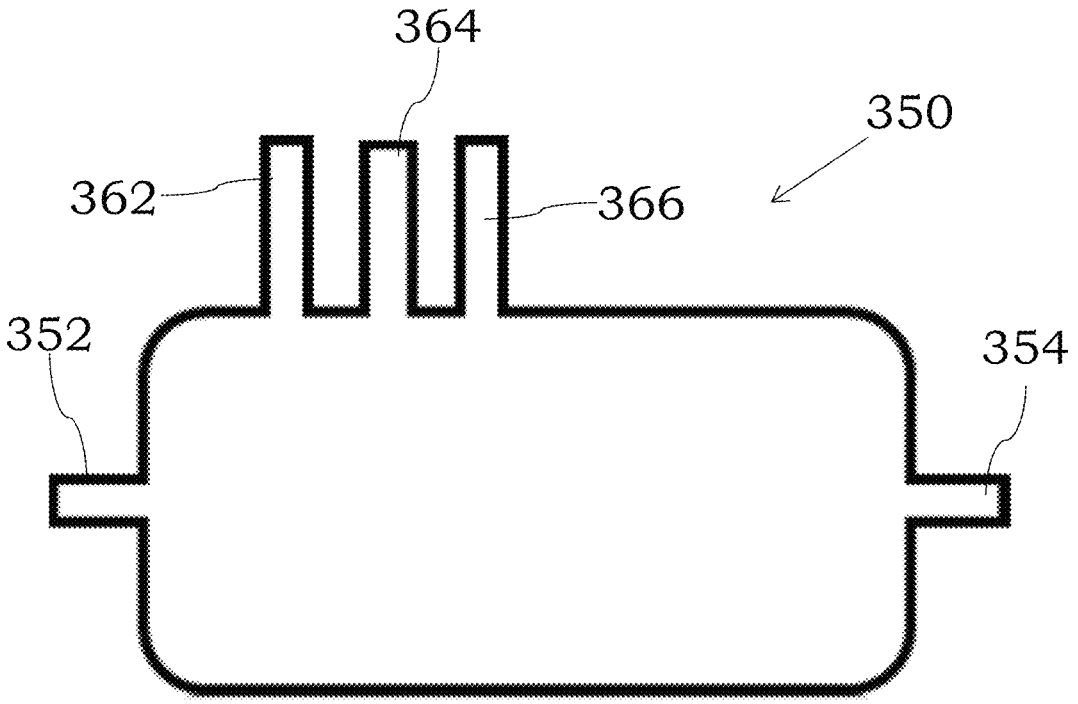
FIG. 3C is another illustration of a sample introduction device comprising three inlet ports one of which can receive a gas comprising a nitrogen center, in accordance with some examples.

In other configurations, a sample introduction device may comprise three or more separate ports where one of the ports can receive a gas comprising a nitrogen center. An illustration is shown in FIG. 3C, where a sample introduction device 350 comprises an inlet 352, an outlet 354, and ports 362, 364 and 366. While ports 362, 364 and 366 are shown as being positioned on the same side or surface of the device 350, this positioning is not required. One or more of the ports 362, 364 and 366 could instead be positioned on a different surface or side of the device 350. Any one or more of the ports 362, 364 and 366 can be used to introduce a gas comprising a nitrogen center into the device 350, e.g., The diameter, shape, etc. of the ports 362, 364, 366 can be the same or can be different. While not shown, a valve or other actuating device (or multiples valves or actuating devices) can be fluidically coupled to one or more of the ports 362, 364 and 366 to permit or prevent flow of the gas comprising the nitrogen center through the respective port. The valve may be, for example, a solenoid valve or may be present in a flow controller.

Figure 3D:
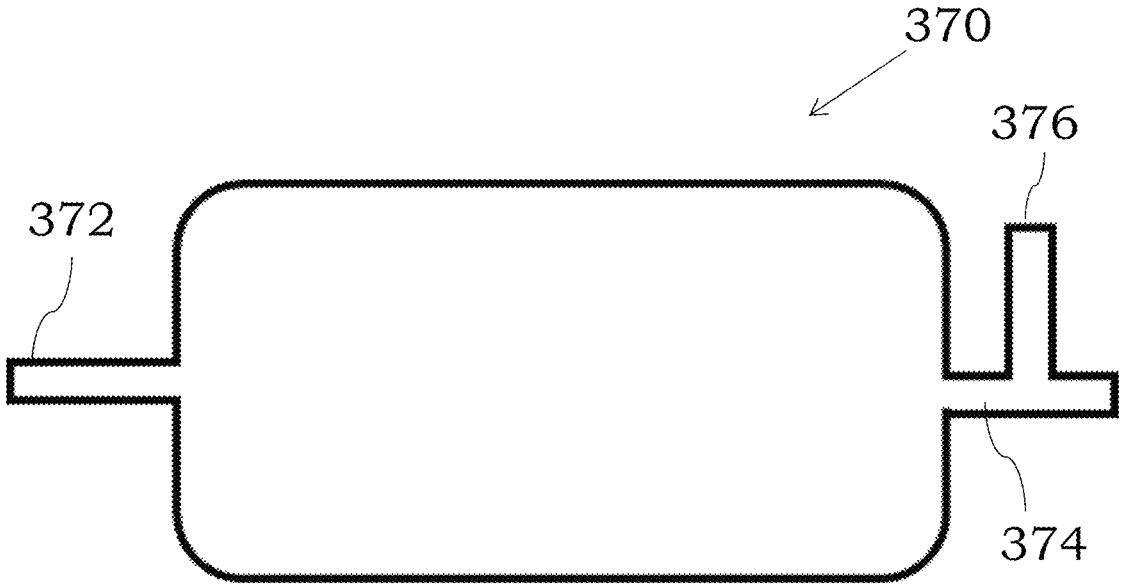
FIG. 3D is an illustration of a sample introduction device comprising a port fluidically coupled to an outlet of the sample introduction device, in accordance with some embodiments.

In some examples, it may desirable to introduce a gas comprising a nitrogen center, at an outlet of the sample introduction device. An illustration is shown in FIG. 3D where a sample introduction device 370 comprises an inlet 372, an outlet 374 and a port 376 fluidically coupled to the outlet 374. As analyte exits the device 370 through the outlet 374, it can be mixed with the gas comprising the nitrogen center by introducing the gas comprising the nitrogen center through the port 376. While not shown, the gas comprising the nitrogen center could instead be introduced into the inlet 372 of the device 370. Alternatively, the nitrogen center could be introduced upstream of the sample introduction device so it is already mixed with sample prior to being provided to the sample introduction device.

Figure 4:
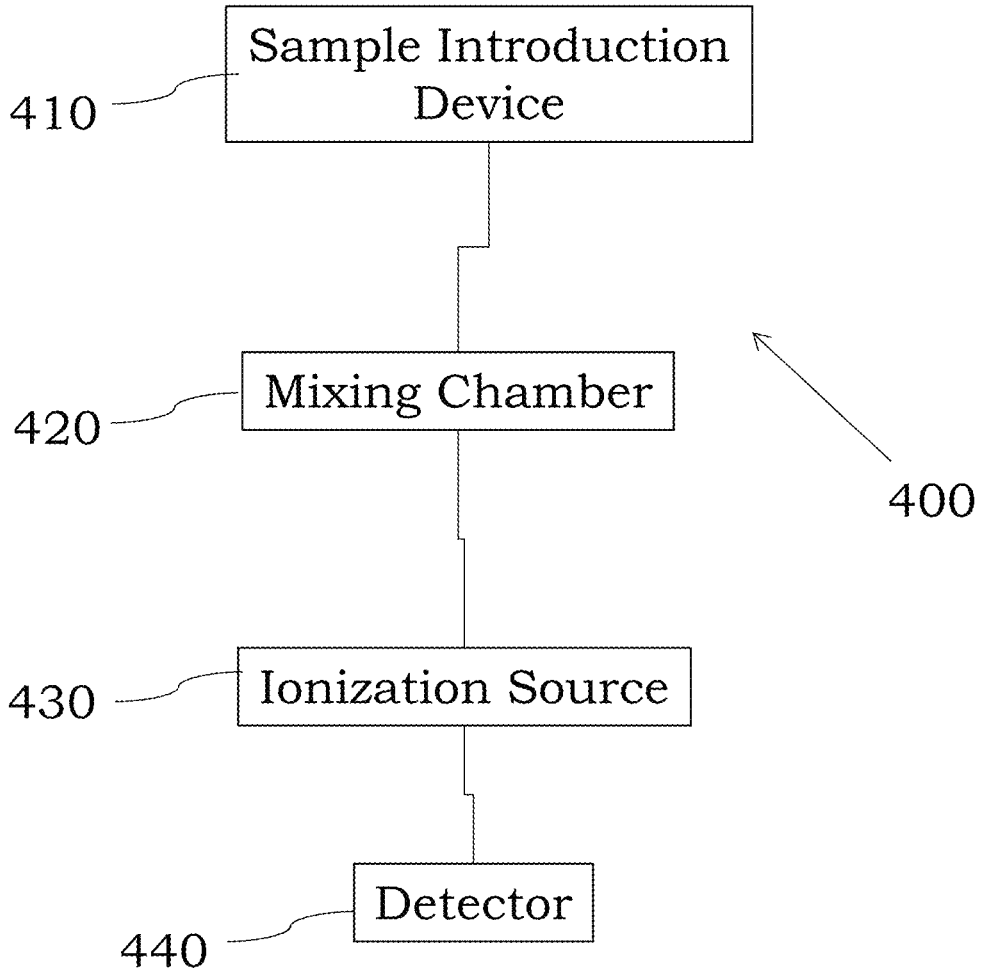
FIG. 4 is an illustration of a system comprising a mixing chamber, in accordance with some examples.

In some examples, it may be desirable to introduce the gas comprising the nitrogen center into a mixing chamber positioned between a sample introduction device and an ionization source. Referring to FIG. 4, a system 400 is shown comprising a sample introduction device 410, a mixing chamber 420, an ionization source 430 and a detector 440. The mixing chamber 420 can be configured to receive a gas comprising a nitrogen center, through a port, valve, manifold or other devices. Sample entering the mixing chamber 420 from the sample introduction device 410 can be mixed with the gas comprising the nitrogen center so a substantially homogeneous mixture of the sample and the gas comprising the nitrogen center exits the mixing chamber 420. The mixing chamber 420 may comprise a body or cavity that permits linear flow, circular flow or other gas flows that can mix the sample and the gas comprising the nitrogen center. In some instances, the mixing chamber 420 can take the form of a spray chamber as described herein. The ionization source 430 may be a plasma or other ionization sources. The detector 440 may be a mass spectrometer, an optical emission device, an atomic absorption device, a time of flight device or other detectors.

Figure 5:
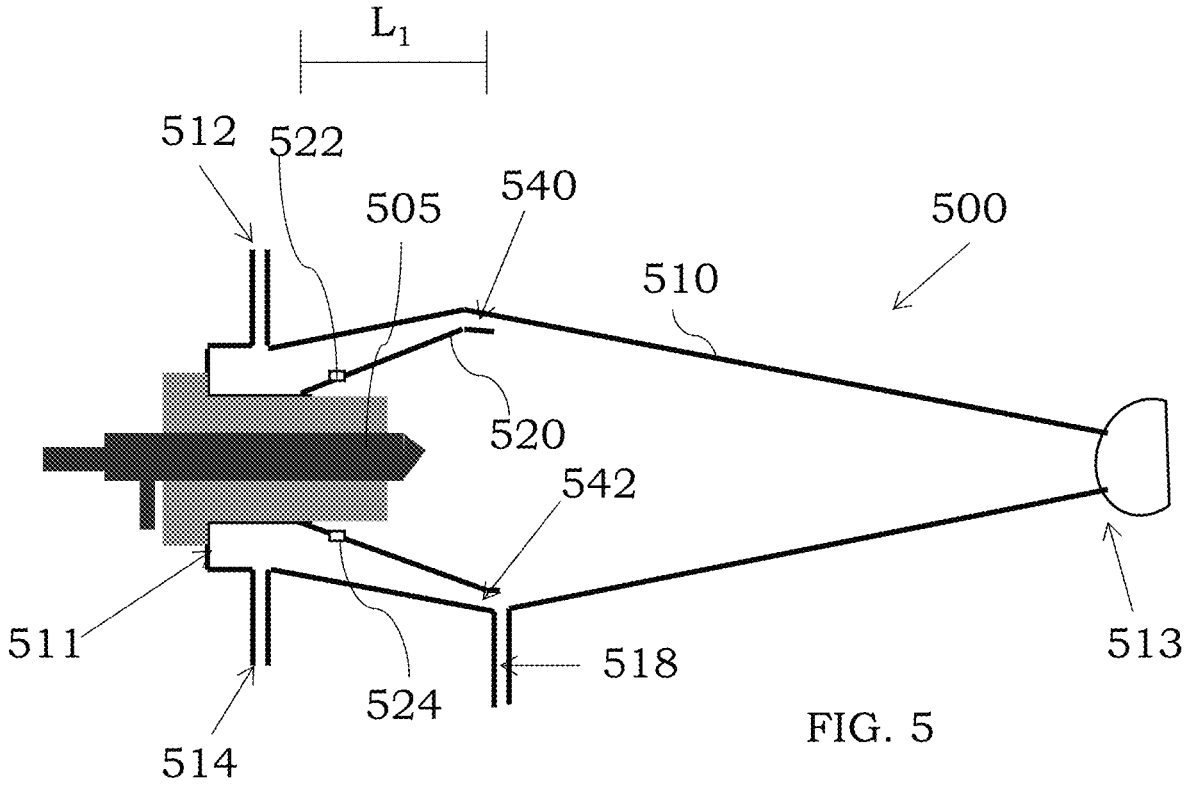
FIG. 5 is an illustration of a spray chamber that can fluidically couple to a gas comprising a nitrogen center, in accordance with some embodiments.

In configurations where a sample introduction device is present, the sample introduction device may be a nebulizer, aerosolizer, spray nozzle or head or other devices. In some embodiments, the sample introduction device can be configured as a spray chamber as shown in FIG. 5. The spray chamber 500 generally comprises an outer chamber or tube 510 and an inner chamber or tube 520. The outer chamber 510 comprises dual makeup gas inlets 512, 514 and a drain 518. The makeup gas inlets 512, 514 are typically fluidically coupled to a common gas source, though different gases could be used if desired, e.g., one of the gas ports can receive a gas comprising a nitrogen center. While not required, the makeup gas inlets 512, 514 are shown as being positioned adjacent to an inlet end 511, though they could instead be positioned centrally or toward an outlet end 513. The inner chamber or tube 520 is positioned adjacent to a nebulizer tip 505 and may comprise two or more microchannels 522, 524 configured to provide a makeup gas flow to reduce or prevent sample from back flowing and/or depositing on the inner chamber or tube 520. The configuration and positioning of the inner chamber or tube 520 provides laminar flow at areas 540, 542 which acts to shield inner surfaces of the outer chamber 510 from any droplet deposition. The tangential gas flow provided by way of gas introduction into the spray chamber 500 through the inlets 512, 514 can acts to select certain droplets. The microchannels 522, 524 in the inner chamber or tube 520 also are designed to permit the gas flows from the makeup gas inlets 512, 514 to shield the surfaces of the inner chamber or tube 520 from droplet deposition. In certain examples, the microchannels 522, 524 can be configured in a similar manner, e.g., have the same size and/or diameter, whereas in other configurations the microchannels 522, 524 may be sized or arranged differently. In some instances, at least two, three, four, five or more separate microchannels can be present in the inner chamber or tube 520. The exact size, form and shape of the microchannels may vary and each microchannel need not have the same size, form or shape. In some examples, different diameter microchannels may exist at different radial planes along a longitudinal axis L1 of the inner tube to provide a desired shielding effect. Illustrative spray chambers are described, for example, in U.S. application Ser. No. 15/597,608 filed on May 17, 2017, the entire disclosure of which is hereby incorporated herein by reference for all purposes. As noted in more detail herein, a third port (or additional ports) may be present and used to introduce a gas comprising a nitrogen center into the spray chamber 500.

In certain embodiments, the exact dimensions of the spray chamber 500 may vary. In certain configurations, a longitudinal length from the nebulizer tip 505 to the end of the spray chamber 500 may be about 10 cm to about 15 cm, e.g., about 12 or 13 cm. The diameter of the outer tube 510 may vary from about 1 cm to about 5 cm, e.g., about 3 cm or 4 cm. The largest diameter of the inner tube 520 may vary from about 0.5 cm to about 4 cm, and the distance between outer surfaces of the inner tube 520 and inner surfaces of the outer tube 510 can be selected to provide a desired laminar flow rate, e.g., the distance may be about 0.1 cm to about 0.75 cm. In certain examples, the inner tube 520 is shown as having a generally increasing internal diameter along the longitudinal axis of the outer chamber 510, but this dimensional change is not required. Some portion of the inner tube 520 may be "flat" or generally parallel with the longitudinal axis L1 to enhance the laminar flow, or in an alternative configuration, some portion of the inner tube 520 may generally be parallel to the surface of the outer tube 510, at least for some length, to enhance laminar flow. The inner diameter of the outer chamber 510 increases from the inlet end 511 toward the outlet end 513 up to a point and then decreases toward the outlet end 513 such that the inner diameter of the outer chamber 510 is smaller at the outlet end 513 than at the inlet end 511. If desired, the inner diameter of the outer chamber 510 may remain constant from the inlet end 511 toward the outlet end 513 or may increase from the inlet end 511 toward the outlet end 513. If desired, two or more different spray chambers which are the same or different can be fluidically coupled to each other to assist in selection of individual cells.

In certain configurations, the systems described herein may comprise one or more ionization sources, which may take many different forms and is generally configured to ionize the elemental species present in a sample. In some examples, the ionization source may be a high temperature ionization source, e.g., one with an average temperature of about 4000 Kelvin or more, such as, for example, a direct current plasma, an inductively coupled plasma, an arc, a spark or other high temperature ionization sources. The exact ionization source used may vary depending on the particular elements and/or cells to be analyzed, and illustrative ionization sources include those which can atomize and/or ionize the elemental species to be detected, e.g., those ionization sources which can atomize and/or ionize metals, metalloids and other inorganic species or organic species. In other examples, the ionization source may comprise an electron impact source, a chemical ionization source, a field ionization source, desorption sources such as, for example, those sources configured for fast atom bombardment, field desorption, laser desorption, plasma desorption, thermal desorption, electrohydrodynamic ionization/desorption, etc., thermospray or electrospray ionization sources or other types of ionization sources.

Figure 6:
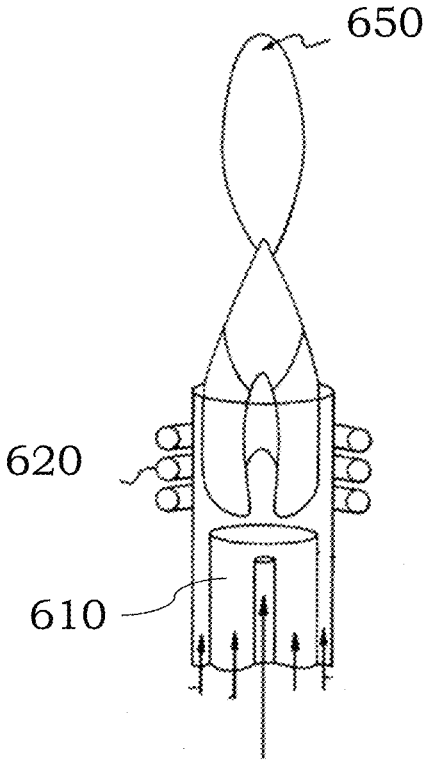
FIG. 6 is an illustration of a torch and a coiled induction device, in accordance with some embodiments.
Figure 7:
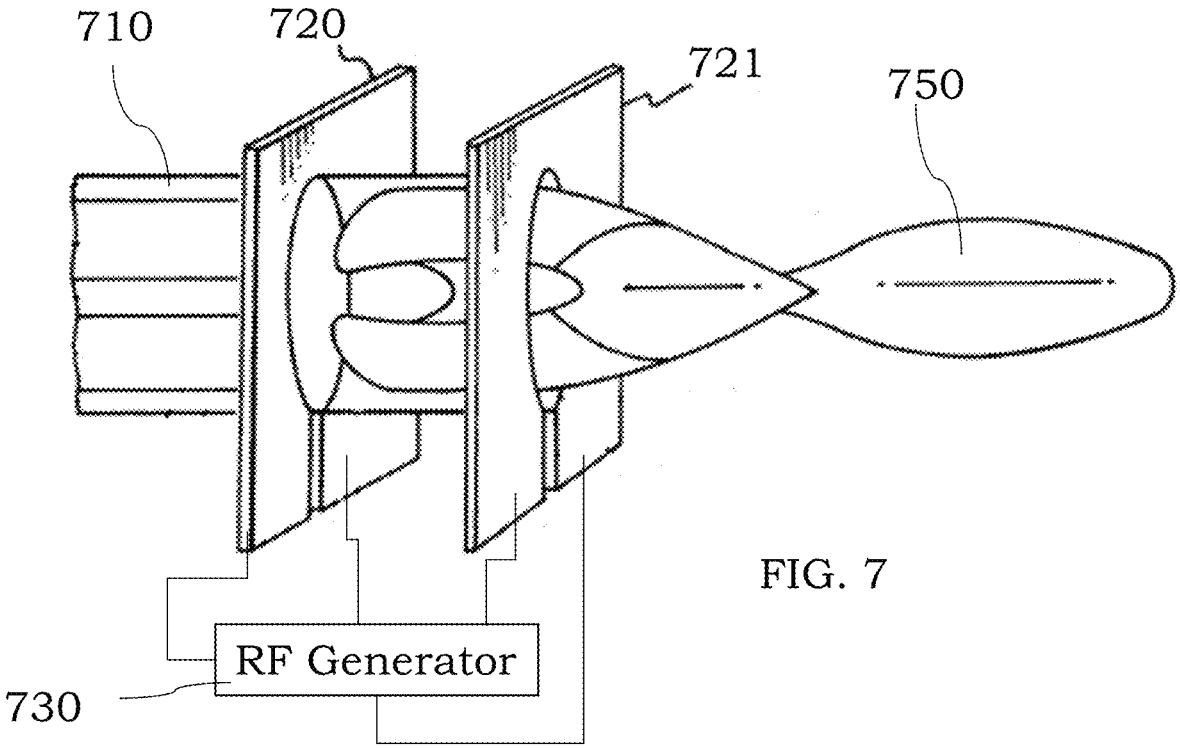
FIG. 7 is an illustration of a torch and plate electrodes, in accordance with certain configurations.
Figure 8:
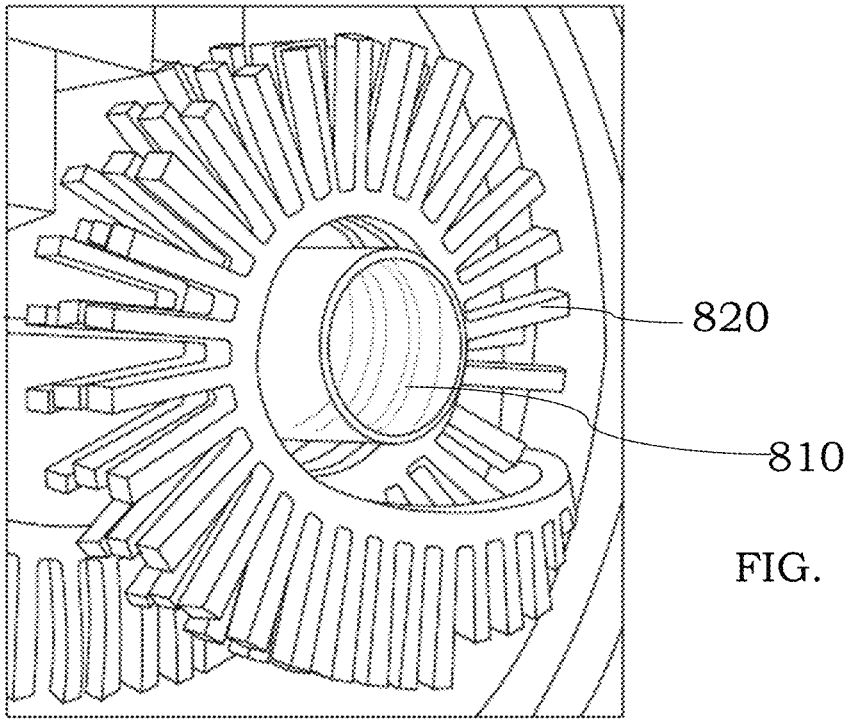
FIG. 8 is an illustration of a torch and a finned induction device, in accordance with some embodiments.

In certain examples, the ionization source may comprise one or more torches and one or more induction devices. Certain components of an ionization source are shown in FIGS. 6-8. Illustrative induction devices and torches are described, for example, in U.S. Pat. Nos. 9,433,073 and 9,360,403, the entire disclosure of which is hereby incorporated herein by reference for all purposes. Referring to FIG. 6, a device comprising a torch 610 in combination with an induction coil 620 is shown. The induction coil 620 is typically electrically coupled to a radio frequency generator (not shown) to provide radio frequency energy into the torch 610 and sustain an inductively coupled plasma 650 within some portion of the torch 610. A sample introduction device (not shown) can be used to introduce sample into the plasma 650 to ionize and/or atomize the elemental species present in the sample. As noted herein, a gas comprising a nitrogen center can be introduced upstream of the plasma 650, e.g., through a sample introduction device, through a port of the torch or somewhere in between. For example, nitrogen gas, ammonia gas, nitrous oxide, nitrogen dioxide or a gas comprising ammonium ions can be introduced upstream of the plasma 650. The ionized and/or atomized elemental species may be detected within the torch using axial or radial detection or can be provided to a downstream chamber or other device, e.g., a mass analyzer, for detection or further selection and/or filtering.

In an alternative configuration, the induction coil 620 in FIG. 6 could be replaced with one or more plate electrodes. For example and referring to FIG. 7, a first plate electrode 720 and a second plate electrode 721 are shown as comprising an aperture that can receive a torch 710. For example, the torch 710 can be placed within some region of an induction device comprising plate electrodes 720, 721. A plasma 750 or other ionization/atomization source such as, for example, an inductively coupled plasma can be sustained using the torch 710 and inductive energy from the plates 720, 721. A radio frequency generator 730 is electrically coupled to each of the plates 720, 721. If desired, only a single plate electrode could be used instead. A sample introduction device can be used to introduce individual sample into the plasma 750 to ionize and/or atomize species in the sample. As noted herein, a gas comprising a nitrogen center can be introduced upstream of the plasma 750. For example, nitrogen gas, ammonia gas, nitrous oxide, nitrogen dioxide or a gas comprising ammonium ions can be introduced upstream of the plasma 750. Illustrative radio frequency generators are described, for example in U.S. Pat. Nos. 4,629,940, 6,329,757, and 9,420,679.

In other configurations, an induction device comprising one or more radial fins could instead be used in methods and systems described herein. Referring to FIG. 8, a device or system may comprise an induction coil 820 comprising at least one radial fin and a torch 810. A plasma or other ionization/atomization source (not shown) such as, for example, an inductively coupled plasma can be sustained using the torch 810 and inductive energy from the radially finned induction device 820. A radio frequency generator (not shown) can be electrically coupled to the induction device 820 to provide radio frequency energy into the torch 810. A sample introduction device (not shown) can be used to introduce individual sample into the torch 810. A gas comprising a nitrogen center can be introduced upstream of a plasma sustained in the torch 810. For example, nitrogen gas, ammonia gas, nitrous oxide, nitrogen dioxide or a gas comprising ammonium ions can be introduced upstream of a plasma sustained in the torch 810. Elemental species in the introduced sample can be ionized or atomized and separated using the downstream mass analyzer. In other instances, one or more capacitive device such as, for example, capacitive coils or capacitive plates can be used in an ionization source. Further two or more induction devices, capacitive devices or other devices which can provide energy into the torch to sustain an atomization/ionization source such as a plasma can also be used.

Figure 9:
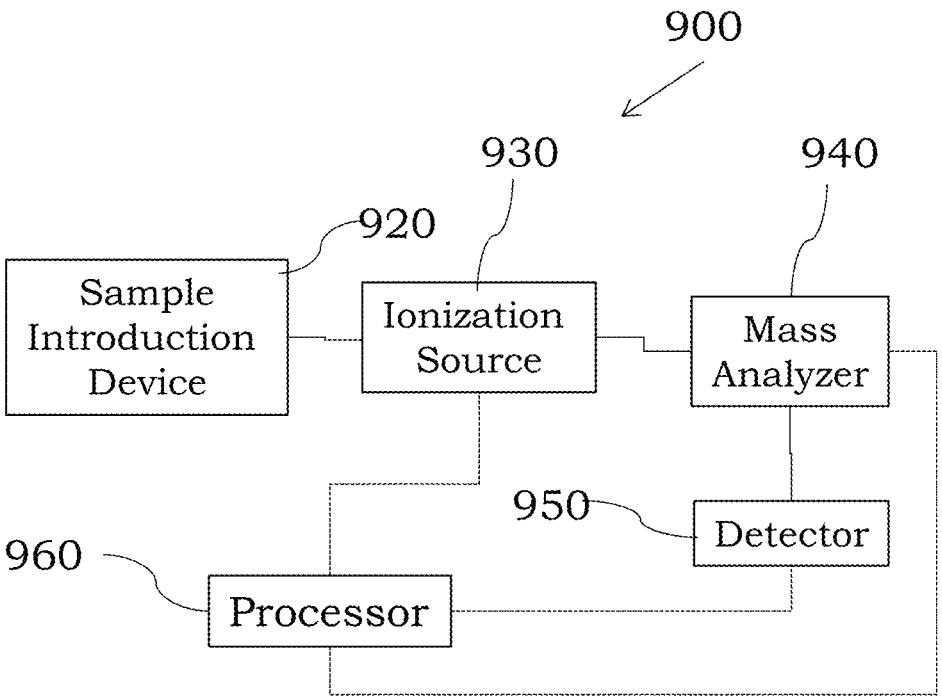
FIG. 9 is a block diagram of certain components that may be present in a mass spectrometer, in accordance with some examples.

In certain embodiments, the systems described herein can be configured as a mass spectrometer. Referring to FIG. 9, a mass spectrometer 900 comprises a sample introduction device 920 fluidically coupled to an ionization source 930. The ionization source 930 is fluidically coupled to a mass analyzer 940. The mass analyzer is fluidically coupled to a detector 950, which can be integral or separate from the mass analyzer 940. A processor 960 can be electrically coupled to one or more components of the system 900 to control the various sub-systems. As discussed herein, the sample introduction device 920 may be a nebulizer, aerosolizer, spray nozzle or head or other devices which can provide the cells to the ionization source 930. The sample introduction device 920 may be, or may comprise, a spray chamber as shown in FIG. 5. The ionization source 930 may be any of those ionization sources described herein, e.g., the induction devices and/or torches shown in FIGS. 6-8. The mass analyzer 940 may take numerous forms depending generally on the sample nature, desired resolution, etc. In certain embodiments, the mass analyzer 940 can be a scanning mass analyzer, a magnetic sector analyzer (e.g., for use in single and double-focusing MS devices), a quadrupole mass analyzer, an ion trap analyzer (e.g., cyclotrons, quadrupole ions traps), time-of-flight analyzers, and other suitable mass analyzers that can separate or filter (or both) elemental species with different mass-to-charge ratios. The mass analyzer 940 may comprise two or more different devices arranged in series, e.g., tandem MS/MS devices or triple quadrupole devices, to select and/or identify the ions that are received from the ionization source 930.

In certain examples, the detector 950 can be any suitable detection device that can be used with existing mass spectrometers, e.g., electron multipliers, Faraday cups, coated photographic plates, scintillation detectors, etc. and other suitable devices that will be selected by the person of ordinary skill in the art, given the benefit of this disclosure. The processor 960 typically includes a microprocessor and/or computer and suitable software for analysis of samples introduced into the system 900. If desired, one or more databases can be accessed by the processor 960 for determination of the chemical identity of species introduced into the system 900.

Figure 10:
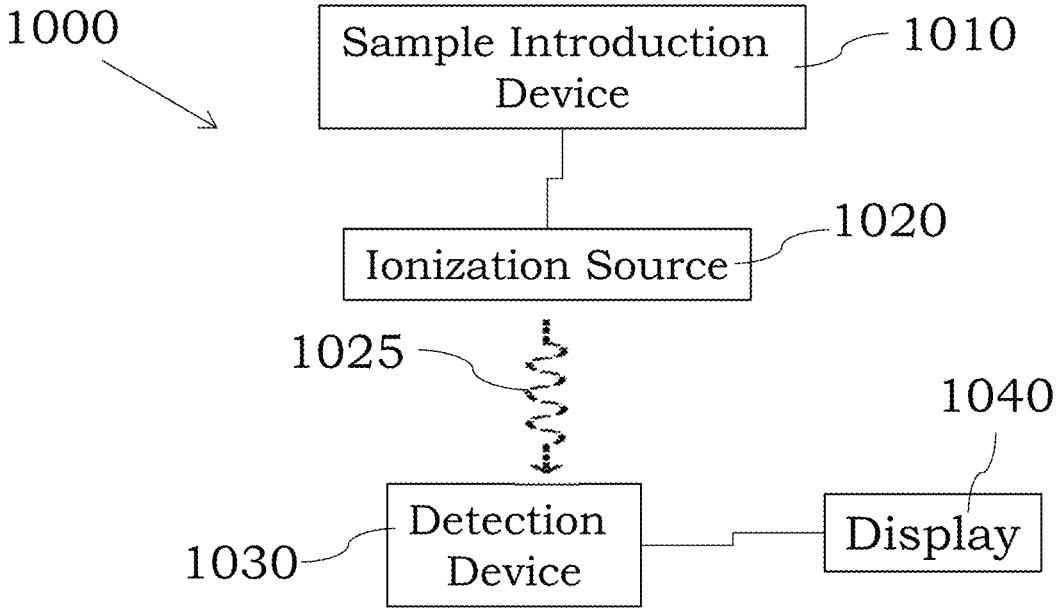
FIG. 10 is a block diagram of an optical emission system, in accordance with some embodiments.

In certain configurations, the elemental species present in the sample can be detected using optical emission spectroscopy (OES). Referring to FIG. 10, an OES device or system 1000 includes a sample introduction device 1010, an ionization source or device 1020 and a detector or detection device 1030. The sample introduction device 1010 may comprise a spray chamber, nebulizer or other forms. The ionization device 1020 may comprise, for example, one or more components as illustrated in FIGS. 6-8 or other devices and components which can provide or sustain an ionization source. The detector or detection device 1030 may take numerous forms and may be any suitable device that may detect optical emissions from elemental species, such as optical emission 1025. If desired, the detection device 1030 may include suitable optics, such as lenses, mirrors, prisms, windows, band-pass filters, etc. The detection device 1030 may also include gratings, such as echelle gratings, to provide a multi-channel OES device. Gratings such as echelle gratings may allow for detection of multiple emission wavelengths. The gratings may be positioned within a monochromator or other suitable device for selection of one or more particular wavelengths to monitor. The detection device 1030 may be configured to monitor emission wavelengths over a large wavelength range including, but not limited to, ultraviolet, visible, near and far infrared, etc. The OES device 1000 may further include suitable electronics such as a microprocessor and/or computer and suitable circuitry to provide a desired signal and/or for data acquisition. Suitable additional devices and circuitry are known in the art and may be found, for example, on commercially available OES devices such as Optima 2100DV series, Optima 5000 DV series OES devices or Optima 8000 or 8300 series OES devices commercially available from PerkinElmer Health Sciences, Inc. An optional display 1040, which may be a readout, screen, printer, computer, etc. may be present to monitor detection of the elemental species. The OES devices may further include autosamplers, such as AS90 and AS93 autosamplers commercially available from PerkinElmer Health Sciences, Inc. or similar devices available from other suppliers. The OES device 1000 can be calibrated, for example, using standard concentration of elements and particles of known size to provide a calibration curve for each element which can be used to quantify each element. If desired, peak height, peak area or both can be used to determine the amount of each of the elements present in the individual particle.

In certain embodiments, the exact wavelengths of emitted light which are detected can be used to identify the particular elemental species that are present in the sample. Many elements can emit light at more than a single wavelength. Atomic species may also emit light at a different wavelength than ionized species. Illustrative optical emissions wavelengths for some different elemental species include, but are not limited to, 328.066 nm or 338.288 nm for silver, 396.151 nm or 308.212 nm for aluminum, 188.980 nm or 193.696 nm for arsenic, 249.772 nm or 249.676 nm for boron, 455.402 nm or 233.524 nm for barium, 313.104 nm or 313.042 nm for beryllium, 317.932 nm or 422.673 nm for calcium, 226.502 nm or 214.434 nm for cadmium, 228.615 nm or 230.785 nm for cobalt, 205.560 nm or 267.711 nm for chromium, 324.754 nm or 327.393 nm for copper, 238.201 nm or 239.568 nm for iron, 766.490 nm for potassium, 670.784 nm for lithium, 285.212 nm or 279.076 nm for magnesium, 257.607 nm or 293.305 nm manganese, 202.032 nm or 203.846 nm for molybdenum, 589.587 nm or 330.237 nm for sodium, 231.604 nm for sodium, 213.617 nm or 178.224 nm for phosphorous, 220.354 nm for lead, 180.671 nm or 181.975 nm for sulfur (as sulfate), 206.834 nm or 217.582 nm for antimony, 196.029 nm for selenium, 251.609 nm or 221.663 nm for silicon, 421.549 nm or 460.733 nm for strontium, 283.730 nm or 401.913 nm for thorium, 334.943 nm or 368.519 nm for titanium, 190.801 nm for thallium, 292.402 nm or 290.880 nm for vanadium, 409.014 nm for uranium, 207.912 nm or 239.708 nm for tungsten, 213.858 nm or 206.199 nm for zinc and 291.138 nm for lutetium. Additional suitable elemental emission wavelengths will be selected by the person of ordinary skill in the art, given the benefit of this disclosure, and depending on the detector selected, the use of radial detection, the use of axial detection, etc.

Figure 11:
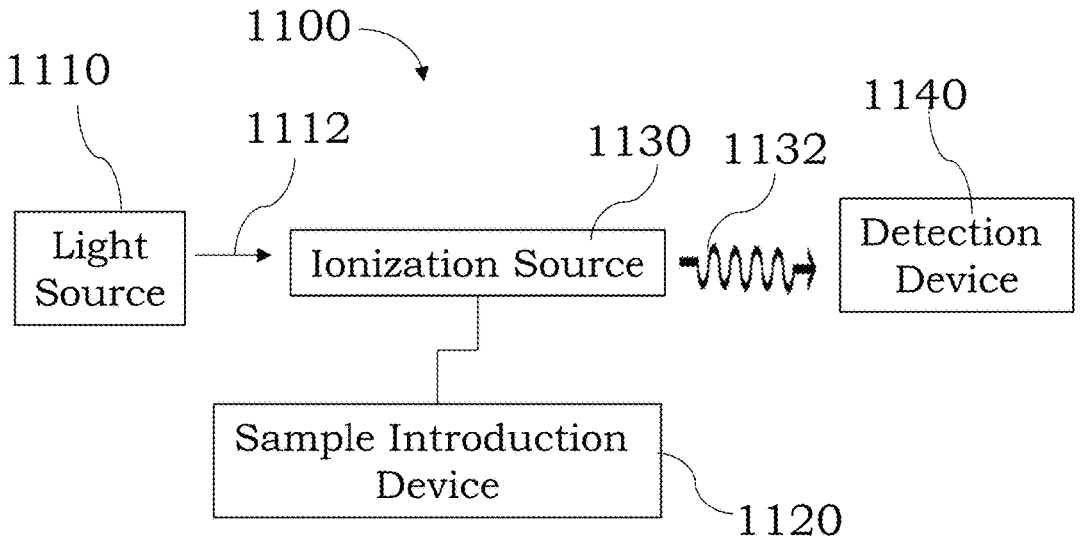
FIG. 11 is an illustration of an atomic absorption system, in accordance with certain configurations.

In certain examples, the elemental species present in the sample can be detected using an atomic absorption spectrometer (AAS) to measure light absorbed by the different elemental species. Referring to FIG. 11, a single beam AAS device 1100 comprises a light source 1110, a sample introduction device 1120, an ionization device or source 1130, and a detection device 1140. The sample introduction device 1120 may be any one or more of those described herein, e.g., a spray chamber, or other suitable sample introduction devices. A power source (not shown) may be configured to supply power to the light source 1110, which provides one or more wavelengths of light 1112 for absorption by atoms and ions in the ionization source 1130. Suitable light sources include, but are not limited to mercury lamps, cathode ray lamps, lasers, etc. The light source 1110 may be pulsed using suitable choppers or pulsed power supplies, or in examples where a laser is implemented, the laser may be pulsed with a selected frequency, e.g. 5, 10, or 20 times/second. The exact configuration of the light source 1110 may vary. For example, the light source 1110 may provide light axially along a torch of the ionization device 1130 or may provide light radially along the torch of the ionization device 1130. The example shown in FIG. 11 is configured for axial supply of light from the light source 1110. There can be signal-to-noise advantages using axial viewing of signals. If desired, the light source can provide light to a chamber separate from the ionization source 1130, e.g. a chamber positioned downstream of the ionization source 1130. For example, the elemental species can be provided from the ionization source 1130 to a downstream chamber that is optically coupled to the light source 1110. Notwithstanding that many different configurations are possible, the detection device 1140 is optically coupled to the light source 1110 so that an amount of light absorbed by a particular elemental species is detected. In some examples, the light source 1110 can provide light of at least two different wavelengths with one wavelength being absorbed by a first elemental species and the other wavelength of light being absorbed by a second elemental species. If desired, a spectrometer can be present between the light source 1110 and the ionization source 1130 (or secondary chamber) to provide a plurality of different individual light wavelengths for absorption by the elemental species. The ionization source 1130 may comprise one or more components as illustrated in FIGS. 6-8 or other devices and components which can provide or sustain an ionization source. As sample is atomized and/or ionized in the ionization device 1130, the incident light 1112 from the light source 1110 may excite atoms. That is, some percentage of the light 1112 that is supplied by the light source 1110 may be absorbed by the atoms and ions in the ionization device 1130. The remaining percentage of the light may be transmitted to the detection device 1140 as wavelength 1132. The detection device 1140 may provide one or more suitable wavelengths using, for example, prisms, lenses, gratings and other suitable devices such as those discussed above in reference to the OES devices, for example. To account for the amount of absorption by sample in the ionization device 1130, a blank, such as water or particles lacking any elemental species, may be introduced prior to sample introduction to provide a 100% transmittance reference value. The amount of light transmitted once sample is introduced into the ionization device 1130 may be measured, and the amount of light transmitted with sample may be divided by the reference value to obtain the transmittance. The negative login of the transmittance is equal to the absorbance. AAS device 1100 may further include suitable electronics such as a microprocessor and/or computer and suitable circuitry to provide a desired signal and/or for data acquisition. Suitable additional devices and circuitry may be found, for example, on commercially available AAS devices such as AAnalyst series spectrometers or PinAAcle spectrometers commercially available from PerkinElmer Health Sciences, Inc. The AAS devices may further include autosamplers known in the art, such as AS-90A, AS-90plus and AS-93plus autosamplers commercially available from PerkinElmer Health Sciences, Inc. Where the ionization source 1130 is configured to sustain an inductively coupled plasma, a radio frequency generator electrically coupled to an induction device may be present. In certain embodiments, a double beam AAS device, instead of a single beam AAS device could instead be used.

In some examples, the wavelength of light absorbed can be used to identify the elemental species present in a sample. Many elements may absorb light at two or more different wavelengths. In addition, atomic species may absorb different wavelength of light than ionized species. It may be desirable to select monitoring wavelengths that do not overlap one another when two or more wavelengths of light are being provided to the ionized elemental species. Further, the wavelength selected may differ when using axial detection and radial detection. Illustrative absorption wavelengths for some different elemental species include, but are not limited to, 328.1 nm for silver, 309.3 nm for aluminum, 193.7 nm for arsenic, 242.8 nm for gold, 249.7 nm for boron, 553.6 for barium, 234.9 nm for beryllium, 223.1 nm for bismuth, 422.7 nm for calcium, 228.8 nm for cadmium, 240.7 nm for cobalt, 357.9 nm for chromium, 852.1 nm for cesium, 324.8 nm for copper, 404.6 nm for dysprosium, 400.8 nm for erbium, 459.4 nm for europium, 248.3 nm for iron, 287.4 nm for gallium, 368.4 nm for gadolinium, 265.1 nm for germanium, 286.6 nm for hafnium, 253.7 nm for mercury, 410.4 nm for holmium, 303.9 nm for indium, 264.0 nm for iridium, 766.5 nm for potassium, 550 nm for lanthanum, 670.8 for lithium, 336.0 nm for lutetium, 285.2 nm for magnesium, 279.5 nm for manganese, 313.3 nm for molybdenum, 589 nm for sodium, 334.4 nm for niobium, 492.4 nm for neodymium, 232.0 nm for nickel, 290.9 nm for osmium, 213.6 nm for phosphorous, 283.3 nm for lead, 244.8 nm for palladium, 495.1 nm for praseodymium, 265.1 nm for platinum, 780.0 nm for rubidium, 346.9 nm for rhenium, 343.5 nm for rhodium, 349.9 nm for ruthenium, 217.6 nm for antimony, 391.2 nm for scandium, 196.0 nm for selenium, 251.16 nm for silicon, 429.7 nm for samarium, 286.3 nm for tin, 460.7 nm for strontium, 271.5 nm for tantalum, 432.6 nm for thorium, 261.4 nm for technetium, 214.3 nm for tellurium, 364.3 nm for titanium, 267.8 nm for thallium, 371.8 nm for thulium, 351.5 nm for uranium, 318.4 nm for vanadium, 255.1 nm for tungsten, 410.2 nm for yttrium, 398.8 nm for ytterbium, 213.9 nm for zinc, and 360.1 nm for zirconium.

In certain embodiments, the fluids comprising the nitrogen center may be selectively switched on or off depending on which particular element is being detected. As noted herein, during analysis of certain "hard-to-ionize" elements, introduction of a gas comprising a nitrogen center may produce interferences that increase background signals that can render detection of the hard-to-ionize elements difficult.

Since an analyte sample may comprise both hard-to-ionize elements and non-hard-to-ionize elements, it can be desirable to improve the detection limits for the non hard-to-ionize elements while at the same time not altering or reducing the detection limits for the hard-to-ionize elements. By selectively introducing the gas comprising the nitrogen center for certain elements and not other elements, analytes of interest can be detected with improved signal-to-noise ratios and/or reduced background signals from interfering species. A processor can be used to correlate detection of a particular element with selective introduction (or selective halting) of the gas comprising the nitrogen center. For example, the system can be designed to continuously introduce the gas comprising the nitrogen center into the gas sample unless a hard-to-ionize element is to be detected. In such instances, the processor may switch off the flow controller or otherwise stop flow of the gas comprising the nitrogen center to permit detection of the hard-to-ionize element in the absence of any nitrogen center introduced into the ionization source. The processor may then switch flow of the gas comprising the nitrogen center back on during detection of other elements. In an alternative configuration, the system can be configured to operate without the gas comprising the nitrogen center unless for certain elements the detection limits would improve in the presence of the gas comprising the nitrogen center. In such instances, the gas can be switched on during analysis of these elements and then switched back off during analysis of other elements. While the gas comprising the nitrogen center is typically not introduced during detection of hard-to-ionize elements, it can be introduced to provide a differential comparison of the signals. For example, a hard-to-ionize element can be detected in the absence of any gas comprising a nitrogen center and in the presence of a gas comprising a nitrogen center. The resulting signals can be compared, for example, to obtain a measure of interfering species that may be present or to provide some indication of background enhancement of interfering signals. In addition, the differential signal can be compared using fluids with different nitrogen centers to determine if a particular nitrogen containing species may work better than other species for certain elements.

In certain examples, the methods and systems herein may comprise or use a processor, which can be part of the system or instrument or present in an associated device, e.g., computer, laptop, mobile device, etc. used with the instrument. For example, the processor can be used to control different components of the system. In certain configurations, the processor may be present in one or more computer systems and/or common hardware circuitry including, for example, a microprocessor and/or suitable software for operating the system, e.g., to control the sample introduction device, ionization source, detector, etc. In some examples, the detection device or detector itself may comprise its own respective processor, operating system and other features to permit detection of various elemental species. The processor can be integral to the systems or may be present on one or more accessory boards, printed circuit boards or computers electrically coupled to the components of the system. The processor is typically electrically coupled to one or more memory units to receive data from the other components of the system and permit adjustment of the various system parameters as needed or desired. The processor may be part of a general-purpose computer such as those based on Unix, Intel PENTIUM-type processor, Motorola PowerPC, Sun UltraSPARC, Hewlett-Packard PA-RISC processors, or any other type of processor. One or more of any type computer system may be used according to various embodiments of the technology. Further, the system may be connected to a single computer or may be distributed among a plurality of computers attached by a communications network. It should be appreciated that other functions, including network communication, can be performed and the technology is not limited to having any particular function or set of functions. Various aspects may be implemented as specialized software executing in a general-purpose computer system. The computer system may include a processor connected to one or more memory devices, such as a disk drive, memory, or other device for storing data. Memory is typically used for storing programs, calibration curves, emission or absorption wavelengths, and data values during operation of the systems. Components of the computer system may be coupled by an interconnection device, which may include one or more buses (e.g., between components that are integrated within a same machine) and/or a network (e.g., between components that reside on separate discrete machines). The interconnection device provides for communications (e.g., signals, data, instructions) to be exchanged between components of the system. The computer system typically can receive and/or issue commands within a processing time, e.g., a few milliseconds, a few microseconds or less, to permit rapid control of the system. For example, computer control can be implemented to control sample introduction, flow of the gas comprising the nitrogen center, detector parameters, etc. The processor typically is electrically coupled to a power source which can, for example, be a direct current source, an alternating current source, a battery, a fuel cell or other power sources or combinations of power sources. The power source can be shared by the other components of the system. The system may also include one or more input devices, for example, a keyboard, mouse, trackball, microphone, touch screen, manual switch (e.g., override switch) and one or more output devices, for example, a printing device, display screen, speaker. In addition, the system may contain one or more communication interfaces that connect the computer system to a communication network (in addition or as an alternative to the interconnection device). The system may also include suitable circuitry to convert signals received from the various electrical devices present in the systems. Such circuitry can be present on a printed circuit board or may be present on a separate board or device that is electrically coupled to the printed circuit board through a suitable interface, e.g., a serial ATA interface, ISA interface, PCI interface or the like or through one or more wireless interfaces, e.g., Bluetooth, Wi-Fi, Near Field Communication or other wireless protocols and/or interfaces.

In certain embodiments, the storage system used in the systems described herein typically includes a computer readable and writeable nonvolatile recording medium in which codes of software can be stored that can be used by a program to be executed by the processor or information stored on or in the medium to be processed by the program. The medium may, for example, be a hard disk, solid state drive or flash memory. The program or instructions to be executed by the processor may be located locally or remotely and can be retrieved by the processor by way of an interconnection mechanism, a communication network or other means as desired. Typically, in operation, the processor causes data to be read from the nonvolatile recording medium into another memory that allows for faster access to the information by the processor than does the medium. This memory is typically a volatile, random access memory such as a dynamic random access memory (DRAM) or static memory (SRAM). It may be located in the storage system or in the memory system. The processor generally manipulates the data within the integrated circuit memory and then copies the data to the medium after processing is completed. A variety of mechanisms are known for managing data movement between the medium and the integrated circuit memory element and the technology is not limited thereto. The technology is also not limited to a particular memory system or storage system. In certain embodiments, the system may also include specially-programmed, special-purpose hardware, for example, an application-specific integrated circuit (ASIC) or a field programmable gate array (FPGA). Aspects of the technology may be implemented in software, hardware or firmware, or any combination thereof. Further, such methods, acts, systems, system elements and components thereof may be implemented as part of the systems described above or as an independent component. Although specific systems are described by way of example as one type of system upon which various aspects of the technology may be practiced, it should be appreciated that aspects are not limited to being implemented on the described system. Various aspects may be practiced on one or more systems having a different architecture or components. The system may comprise a general-purpose computer system that is programmable using a high-level computer programming language. The systems may be also implemented using specially programmed, special purpose hardware. In the systems, the processor is typically a commercially available processor such as the well-known Pentium class processors available from the Intel Corporation. Many other processors are also commercially available. Such a processor usually executes an operating system which may be, for example, the Windows 95, Windows 98, Windows NT, Windows 2000 (Windows ME), Windows XP, Windows Vista, Windows 7, Windows 8 or Windows 10 operating systems available from the Microsoft Corporation, MAC OS X, e.g., Snow Leopard, Lion, Mountain Lion or other versions available from Apple, the Solaris operating system available from Sun Microsystems, or UNIX or Linux operating systems available from various sources. Many other operating systems may be used, and in certain embodiments a simple set of commands or instructions may function as the operating system. Further, the processor can be designed as a quantum processor designed to perform one or more functions using one or more qubits.

In certain examples, the processor and operating system may together define a platform for which application programs in high-level programming languages may be written. It should be understood that the technology is not limited to a particular system platform, processor, operating system, or network. Also, it should be apparent to those skilled in the art, given the benefit of this disclosure, that the present technology is not limited to a specific programming language or computer system. Further, it should be appreciated that other appropriate programming languages and other appropriate systems could also be used. In certain examples, the hardware or software can be configured to implement cognitive architecture, neural networks or other suitable implementations. If desired, one or more portions of the computer system may be distributed across one or more computer systems coupled to a communications network. These computer systems also may be general-purpose computer systems. For example, various aspects may be distributed among one or more computer systems configured to provide a service (e.g., servers) to one or more client computers, or to perform an overall task as part of a distributed system. For example, various aspects may be performed on a client-server or multi-tier system that includes components distributed among one or more server systems that perform various functions according to various embodiments. These components may be executable, intermediate (e.g., IL) or interpreted (e.g., Java) code which communicate over a communication network (e.g., the Internet) using a communication protocol (e.g., TCP/IP). It should also be appreciated that the technology is not limited to executing on any particular system or group of systems. Also, it should be appreciated that the technology is not limited to any particular distributed architecture, network, or communication protocol.

In some instances, various embodiments may be programmed using an object-oriented programming language, such as, for example, SQL, SmallTalk, Basic, Java, Javascript, PHP, C++, Ada, Python, iOS/Swift, Ruby on Rails or C # (C-Sharp). Other object-oriented programming languages may also be used. Alternatively, functional, scripting, and/or logical programming languages may be used. Various configurations may be implemented in a non-programmed environment (e.g., documents created in HTML, XML or other format that, when viewed in a window of a browser program, render aspects of a graphical-user interface (GUI) or perform other functions). Certain configurations may be implemented as programmed or non-programmed elements, or any combination thereof. In some instances, the systems may comprise a remote interface such as those present on a mobile device, tablet, laptop computer or other portable devices which can communicate through a wired or wireless interface and permit operation of the systems remotely as desired.

In certain examples, the processor may also comprise, or have access to, a database of information about elemental species and the like, which can include optical emission wavelengths, optical absorption wavelengths and other common information. For example, a collection of calibration curves for different elemental species can be stored in the database and used to estimate elemental concentrations in the sample without the need for the user to perform calibration curves for each of the elements. Such methods may be particularly desirable where the amount of sample is limited. The instructions stored in the memory can execute a software module or control routine for the system, which in effect can provide a controllable model of the system. The processor can use information accessed from the database together with one or software modules executed in the processor to determine control parameters or values for different components of the systems, e.g., different gas flow rates, different light wavelengths to be monitored, etc. Using input interfaces to receive control instructions and output interfaces linked to different system components in the system, the processor can perform active control over the system. For example, the processor can control the detection device, sample introduction devices, ionization sources, flow controllers, etc.

Figure 12:
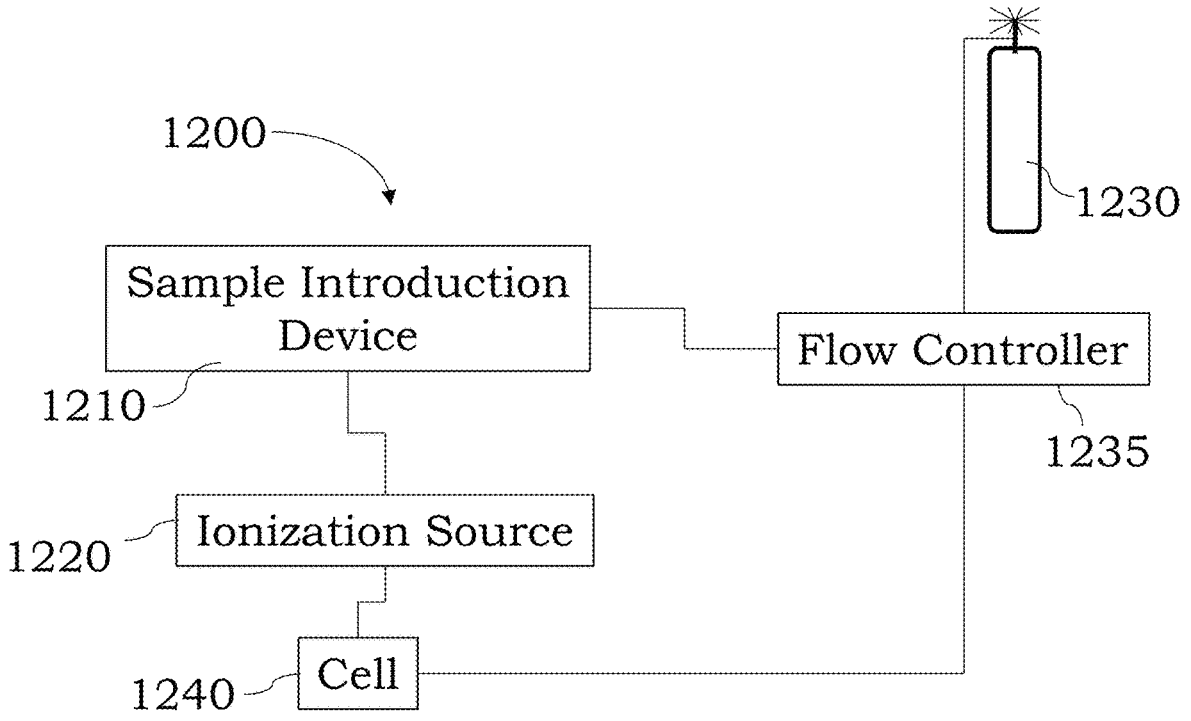
FIG. 12 is an illustration of a system comprising a gas source fluidically coupled to two or more components, in accordance with some embodiments.

In some embodiments, the gas comprising the nitrogen center may also be introduced into another component of the system that is downstream of the ionization source. Referring to FIG. 12, a system 1200 is shown where a gas source 1230 comprising a gas with a nitrogen center is fluidically coupled to a sample introduction device 1210 and a cell 1240 downstream of an ionization source 1220. If desired, an optional flow controller 1235 can be present and used to control flow of the gas independently to the sample introduction device 1210 and the cell 1240 from the gas source 1230. In some examples, the cell 1240 may take the form of a collision cell, a reaction cell, or a collision-reaction cell as described, for example, in U.S. Pat. No. 8,426,804. In certain examples, the gas from the gas source 1230 could also or instead be provided to a downstream component other than the cell 1240, e.g., it could be provided to a detector, mass analyzer or other components downstream from the ionization source 1220.

Certain specific examples are described below to illustrate some of the novel and inventive aspects of the technology described herein.

Example 1

An inductively coupled mass spectrometer system (NexION ICP-MS) comprising a spray chamber commercially available from PerkinElmer Health Sciences, Inc, e.g., an All Matrix Solution spray chamber, was used to measure signals (background signals and elemental signals). Table 1 below shows the results with the values representing the counts per second (cps) for each element detected. 100 parts per trillion of each element was separately introduced into the mass spectrometer. No nitrogen center gas was introduced into the spray chamber. Analysis was performed in DRC mode in the presence of ammonia in the reaction cell.

TABLE 1

| Element Detected | Elemental Signal (cps) | Average Background Signal (cps) | Detection Limit (ppt) | BEC (ppt) |
|---|---|---|---|---|
| Iron | 7042.04 | 643.9 | 0.60 | 10.06 |
| Calcium | 6890.0 | 527.3 | 0.64 | 8.29 |
| Potassium | 6710.9 | 409.9 | 0.93 | 6.51 |

Detection limits were calculated using the standard deviation of the blank signal (3× std. deviation of the blank signal) divided by the analytical signal. A desired detection limit is 1 ppt or below. Background equivalent concentrations for the iron, calcium and potassium were 10.6, 8.29 and 6.51 ppt, respectively.

Example 2

The same system used in Example 1 was used to measure signals (background signals and elemental signals) in the presence of nitrogen gas (1% by volume) introduced into the spray chamber. Table 2 below shows the results with the values representing the counts per second (cps) for each element detected. 100 parts per trillion of each element was separately introduced into the mass spectrometer.

TABLE 2

| Element Detected | Elemental Signal (cps) | Average Background Signal (cps) | Detection Limit (ppt) | BEC (ppt) |
|---|---|---|---|---|
| Iron | 4304.0 | 25.2 | 0.33 | 0.59 |
| Calcium | 3361.4 | 223.9 | 1.64 | 7.13 |
| Potassium | 3136.0 | 409.9 | 0.93 | 1.18 |

The results were consistent with the background equivalent concentrations (BEC) improving in the presence of the nitrogen gas introduced into the spray chamber while operating the reaction cell with ammonia gas. Calcium detection limits did not improve because the primary interference is Ar+ and the nitrogen did not have an effect on this species. The BEC and hence the detection limit for the other elements improved due to the ArX+ species not forming (or forming to a lower degree) when nitrogen is introduced. Background signals decreased significantly compared to the background signals measured in Example 1. Signal intensities for all elements (analytical and background signals) also decreased compared to signal intensities in Example 1, however at reduced rate compared to the background signal. Background equivalent concentrations (BEC's) in the presence of the nitrogen gas for the iron, calcium and potassium were 0.59, 7.13 and 1.18 ppt, respectively. BEC's improved for all three elements.

Example 3

Background equivalent concentration (BEC's) in the absence and presence of nitrogen gas were determined for each of the elements shown in Table 3 in FIG. 13 using the system in Example 1. The elements were present in an aqueous solution of 13% nitric acid. Addition of the nitrogen gas improved BEC's for numerous elements particularly those that easily oxidize (Uranium, Vanadium). The values in Table 3 are expressed as (Log BEC)/parts per trillion.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. A method comprising:

introducing a gas comprising a nitrogen center upstream of an inductively coupled plasma sustained in a torch, wherein the torch is configured to sustain the inductively coupled plasma using a plasma gas introduced into the torch, and wherein elements in a sample introduced into the sustained inductively coupled plasma are ionized by the sustained inductively coupled plasma; and discontinuing introduction of the gas comprising the nitrogen center when the sample introduced into the sustained inductively coupled plasma comprises a hard-to-ionize element, wherein the sustained inductively coupled plasma ionizes the hard-to-ionize element in the introduced sample, and wherein the hard-to-ionize element comprises beryllium, zinc, selenium or arsenic.

2. The method of claim 1, wherein the gas comprising the nitrogen center is introduced into the torch in a gas flow that is separate from the plasma gas provided to the torch and is separate from any cooling gases provided to the torch to cool glassware of the torch.

3. The method of claim 1, further comprising introducing the gas comprising the nitrogen center into a spray chamber positioned upstream of the torch and fluidically coupled to a sample inlet of the torch.

4. The method of claim 3, wherein the gas comprising the nitrogen center is introduced through a secondary port of the spray chamber.

5. The method of claim 4, wherein the secondary port of the spray chamber is positioned perpendicular to a longitudinal axis of the spray chamber.

6. The method of claim 3, further comprising switching on the introduction of the gas comprising the nitrogen center into the spray chamber when an element other than a hard-to-ionize element is being analyzed using the inductively coupled plasma.

7. The method of claim 3, further comprising configuring the introduced gas comprising the nitrogen center to comprise up to about 50% by volume of a total gas flow introduced into the torch.

8. The method of claim 1, wherein the gas comprising the nitrogen center is nitrogen gas, ammonia gas, nitrous oxide, nitrogen dioxide or a gas comprising ammonium ions.

9. The method of claim 1, further comprising introducing the gas comprising the nitrogen center into a port of the torch that provides the plasma gas to sustain the inductively coupled plasma in the torch.

10. A mass spectrometer system comprising:

a sample introduction device comprising a first port and a second port, wherein the first port receives a first gas and the second port receives a second gas different from the first gas, and wherein the second gas comprises a nitrogen center;

a torch fluidically coupled to the sample introduction device and configured to receive sample from the sample introduction device at a sample inlet of the torch;

an induction device configured to provide radio frequency energy into the torch to sustain an inductively coupled plasma in the torch to ionize the sample;

a mass analyzer fluidically coupled to a sample outlet of the torch and configured to receive ions from the torch;

a detector fluidically coupled to the mass analyzer; and a processor configured to prevent introduction of the second gas into the sample introduction device when a sample comprising a hard-to-ionize element is being analyzed using the mass spectrometer system and permit entry of the second gas into the sample introduction device when an element other than a hard-to-ionize element is being analyzed using the mass spectrometer system, wherein the hard-to-ionize element of the sample comprises beryllium, zinc, selenium or arsenic.

11. The mass spectrometer system of claim 10, wherein the sample introduction device comprises a spray chamber positioned upstream of the torch and fluidically coupled to a sample inlet of the torch.

12. The mass spectrometer system of claim 11, wherein the spray chamber comprises the second port through which the second gas is introduced and comprises the first port through which the first gas is introduced.

13. The mass spectrometer system of claim 12, wherein the second port of the spray chamber is positioned perpendicular to a longitudinal axis of the spray chamber.

14. The mass spectrometer system of claim 10, wherein the processor is further configured to control an amount of the second gas comprising the nitrogen center introduced into the sample introduction device.

15. An optical emission spectrometer system comprising:

a sample introduction device comprising a first port and a second port, wherein the first port receives a first gas and the second port receives a second gas different from the first gas, and wherein the second gas comprises a nitrogen center;

a torch fluidically coupled to the sample introduction device and configured to receive sample from the sample introduction device at a sample inlet of the torch;

an induction device configured to provide radio frequency energy into the torch to sustain an inductively coupled plasma in the torch to ionize the sample;

an optical detector configured to detect optical emissions of excited analyte in the torch; and a processor configured to prevent introduction of the second gas into the sample introduction device when a sample comprising a hard-to-ionize element is being analyzed using the optical emission spectrometer system and permit entry of the second gas into the sample introduction device when an element other than a hard-to-ionize element is being analyzed using the optical emission spectrometer system, wherein the hard-to-ionize element of the sample comprises beryllium, zinc, selenium or arsenic.

16. The optical emission spectrometer system of claim 15, wherein the sample introduction device comprises a spray chamber positioned upstream of the torch and fluidically coupled to a sample inlet of the torch.

17. The optical emission spectrometer system of claim 16, wherein the spray chamber comprises the second port through which the second gas is introduced and comprises the first port through which the first gas is introduced.

18. The optical emission spectrometer system of claim 17, wherein the second port of the spray chamber is positioned perpendicular to a longitudinal axis of the spray chamber.

19. The optical emission spectrometer system of claim 15, wherein the processor is further configured to control an amount of the second gas comprising the nitrogen center introduced into the sample introduction device.

* * * * *